US006749728B2

(12) United States Patent
Wang

(10) Patent No.: US 6,749,728 B2
(45) Date of Patent: Jun. 15, 2004

(54) METHODS AND APPARATUS FOR HOLDING AND POSITIONING SEMICONDUCTOR WORKPIECES DURING ELECTROPOLISHING AND/OR ELECTROPLATING OF THE WORKPIECES

(75) Inventor: Hui Wang, Fremont, CA (US)

(73) Assignee: ACM Research, Inc., Fremont, CA (US)

( * ) Notice: Subject to any disclaimer, the term of this patent is extended or adjusted under 35 U.S.C. 154(b) by 0 days.

(21) Appl. No.: 10/321,780

(22) Filed: Dec. 16, 2002

(65) Prior Publication Data

US 2003/0132105 A1 Jul. 17, 2003

Related U.S. Application Data

(63) Continuation of application No. 09/800,990, filed on Mar. 7, 2001, now Pat. No. 6,495,007, which is a continuation of application No. 09/390,458, filed on Sep. 7, 1999, now Pat. No. 6,248,222.

(60) Provisional application No. 60/099,515, filed on Sep. 8, 1998, and provisional application No. 60/110,134, filed on Nov. 28, 1998.

(51) Int. Cl.[7] ..... C25B 9/02

(52) U.S. Cl. ..... 204/297.09; 204/297.01; 204/297.08; 204/297.1; 204/297.14

(58) Field of Search ..... 204/297.01, 297.08, 204/297.09, 297.1, 297.14

(56) References Cited

U.S. PATENT DOCUMENTS

| | | | | |
|---|---|---|---|---|
| 4,304,641 A | | 12/1981 | Grandia et al. | 204/23 |
| 4,339,319 A | | 7/1982 | Aigo | 204/224 R |
| 5,222,310 A | | 6/1993 | Thompson et al. | 204/297.1 |
| 5,227,041 A | | 7/1993 | Brogden et al. | 204/297 R |
| 5,324,410 A | * | 6/1994 | Kummer et al. | 204/297.05 |
| 5,377,708 A | | 1/1995 | Bergman et al. | 134/105 |
| 5,405,518 A | | 4/1995 | Hsieh et al. | 204/297 R |
| 5,421,987 A | | 6/1995 | Tzanavaras et al. | 205/133 |
| 5,443,707 A | | 8/1995 | Mori | 204/242 |
| 5,489,341 A | | 2/1996 | Bergman et al. | 134/26 |
| 5,516,412 A | | 5/1996 | Andricacos et al. | 204/224 R |
| 5,584,310 A | | 12/1996 | Bergman et al. | 134/95.1 |

(List continued on next page.)

FOREIGN PATENT DOCUMENTS

| | | |
|---|---|---|
| EP | 0 257 670 | 3/1988 |
| EP | 0 831 526 | 3/1998 |
| WO | WO 90/00476 | 1/1990 |
| WO | WO 95/20064 | 7/1995 |

OTHER PUBLICATIONS

Contolini et al., "Copper Electroplating Process for Sub–Half–Micron ULSI Structures", VMIC Coference 1995, ISMIC–104/95/0322, Jun. 27–29, 1995, pp. 322–328.

(List continued on next page.)

*Primary Examiner*—Bruce F. Bell
(74) *Attorney, Agent, or Firm*—Morrison & Foerster LLP

(57) ABSTRACT

A wafer chuck for holding a wafer during electropolishing and/or electroplating of the wafer includes a top section, a bottom section, and a spring member. In accordance with one aspect of the present invention, the top section and the bottom section are configured to receive the wafer for processing. The spring member is disposed on the bottom section and configured to apply an electric charge to the wafer. In accordance with another aspect of the present invention, the spring member contacts a portion of the outer perimeter of the wafer. In one alternative configuration of the present invention, the wafer chuck further includes a seal member to seal the spring member from the electrolyte solution used in the electropolishing and/or electroplating process.

20 Claims, 25 Drawing Sheets

U.S. PATENT DOCUMENTS

| | | | | | |
|---|---|---|---|---|---|
| 5,620,581 | A | | 4/1997 | Ang | 205/96 |
| 5,670,034 | A | | 9/1997 | Lowery | 205/143 |
| 5,678,320 | A | | 10/1997 | Thompson et al. | 34/58 |
| 5,744,019 | A | | 4/1998 | Ang | 205/96 |
| 5,932,077 | A | | 8/1999 | Reynolds | 204/224 R |
| 5,980,706 | A | | 11/1999 | Bleck et al. | 204/297 R |
| 6,080,291 | A | | 6/2000 | Woodruff et al. | 204/297.01 |
| 6,248,222 | B1 | * | 6/2001 | Wang | 204/297.09 |
| 6,280,582 | B1 | | 8/2001 | Woodruff et al. | 204/242 |
| 6,303,010 | B1 | | 10/2001 | Woodruff et al. | 204/297.01 |
| 6,309,524 | B1 | | 10/2001 | Woodruff et al. | 204/297.1 |
| 6,358,388 | B1 | | 3/2002 | Bleck et al. | 205/118 |
| 6,365,020 | B1 | | 4/2002 | Yoshioka et al. | 204/297.14 |
| 6,391,166 | B1 | * | 5/2002 | Wang | 204/224 R |
| 6,416,647 | B1 | | 7/2002 | Dordi et al. | 205/137 |
| 6,495,007 | B2 | * | 12/2002 | Wang | 204/297.01 |

OTHER PUBLICATIONS

Devaraj et al., "Pulsed Electrodeposition of Copper", Plating & Surface Finishing Aug. 1992, pp. 72–78.

Dubin et al., "Copper Plating Techniques for ULSI Metallization", Advanced MicroDevices.

Dubin, "Electrochemical Deposition of Copper for On–Chip Interconnects", Advanced MicroDevices.

Gauvin et al., "The Effect of Chloride Ions on Copper Deposition", J. of Electrochemical Society, Feb. 1952, vol. 99, p. 71–75.

Osero, "An Overview of Pulse Plating", Plating and Surface Finishig, Mar. 1986.

Passal, "Copper Plating During the last Fifty Years", Plating Jun. 1959, pp. 628–638.

Singer, "Copper Goes Mainstream: Low k to Follow", Semiconductor International Nov. 1997, pp. 67–70.

Patent Abstract of Japan, "Plating Method", Publication No. 57171690, Publication Date: Oct. 22, 1982.

Patent Abstract of Japan, "Partial Plating Device", Publication No. 01234590, Publication date: Sep. 19, 1989.

* cited by examiner

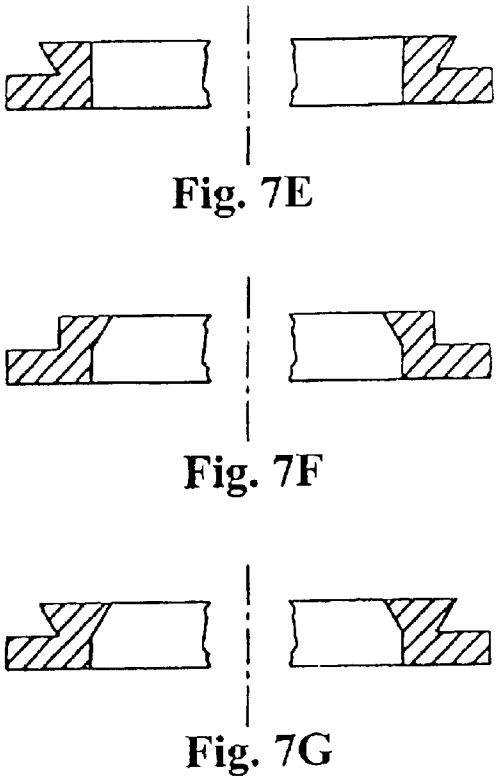
Fig. 7E
Fig. 7F
Fig. 7G
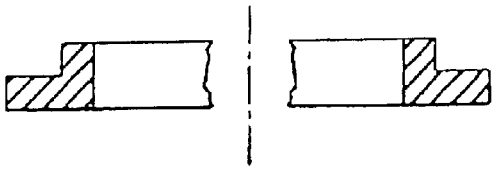
Fig. 7A
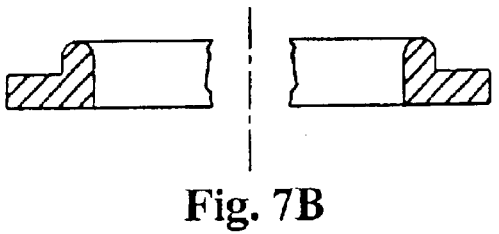
Fig. 7B
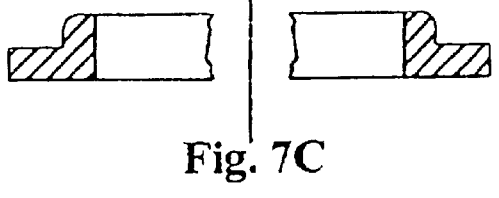
Fig. 7C
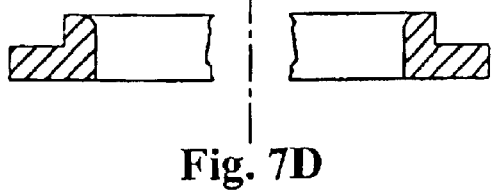
Fig. 7D

METHODS AND APPARATUS FOR HOLDING AND POSITIONING SEMICONDUCTOR WORKPIECES DURING ELECTROPOLISHING AND/OR ELECTROPLATING OF THE WORKPIECES

CROSS-REFERENCE TO RELATED APPLICATIONS

This application is a continuation of U.S. Ser. No. 09/800,990, filed Mar. 7, 2001, now U.S. Pat. No. 6,495,007, which is a continuation of U.S. Ser. No. 09/390,458, filed Sep. 7, 1999, now U.S. Pat. No. 6,248,222, which claims the benefit of earlier filed U.S. Provisional Application Serial No. 60/099,515, filed Sep. 8, 1998 and earlier filed U.S. Provisional Application Serial No. 60/110,134, filed Nov. 28, 1998.

BACKGROUND OF THE INVENTION

1. Field of the Invention

The present invention generally relates to methods and apparatus for holding and positioning semiconductor workpieces during processing of the workpieces. More particularly, the present invention relates to a system for electropolishing and/or electroplating metal layers on semiconductor wafers.

2. Description of the Related Art

In general, semiconductor devices are manufactured or fabricated on disks of semiconducting materials called wafers or slices. More particularly, wafers are initially sliced from a silicon ingot. The wafers then undergo multiple masking, etching, and deposition processes to form the electronic circuitry of semiconductor devices.

During the past decades, the semiconductor industry has increased the power of semiconductor devices in accordance with Moore's law, which predicts that the power of semiconductor devices will double every 18 months. This increase in the power of semiconductor devices has been achieved in part by decreasing the feature size (i.e., the smallest dimension present on a device) of these semiconductor devices. In fact, the feature size of semiconductor devices has quickly gone from 0.35 microns to 0.25 microns, and now to 0.18 microns. Undoubtedly, this trend toward smaller semiconductor devices is likely to proceed well beyond the sub-0.18 micron stage.

However, one potential limiting factor to developing more powerful semiconductor devices is the increasing signal delays at the interconnections (the lines of conductors, which connect elements of a single semiconductor device and/or connect any number of semiconductor devices together). As the feature size of semiconductor devices has decreased, the density of interconnections on the devices has increased. However, the closer proximity of interconnections increases the line-to-line capacitance of the interconnections, which results in greater signal delay at the interconnections. In general, interconnection delays have been found to increase with the square of the reduction in feature size. In contrast, gate delays (i.e., delay at the gates or mesas of semiconductor devices) have been found to increase linearly with the reduction in feature size.

One conventional approach to compensate for this increase in interconnection delay has been to add more layers of metal. However, this approach has the disadvantage of increasing production costs associated with forming the additional layers of metal. Furthermore, these additional layers of metal generate additional heat, which can be adverse to both chip performance and reliability.

Consequently, the semiconductor industry has started to use copper rather than aluminum to form the metal interconnections. One advantage of copper is that it has greater conductivity than aluminum. Also, copper is less resistant to electromigration (meaning that a line formed from copper will have less tendency to thin under current load) than aluminum.

However, before copper can be widely used by the semiconductor industry, new processing techniques are required. More particularly, a copper layer may be formed on a wafer using an electroplating process and/or etched using an electropolishing process. In general, in an electroplating and/or an electropolishing process, the wafer is held within an electrolyte solution and an electric charge is then applied to the wafer. Thus, a wafer chuck is needed for holding the wafer and applying the electric charge to the wafer during the electroplating and/or electropolishing process.

SUMMARY OF THE INVENTION

In an exemplary embodiment of the present invention, a wafer chuck for holding a wafer during electropolishing and/or electroplating of the wafer includes a top section, a bottom section, and a spring member. In accordance with one aspect of the present invention, the top section and the bottom section are configured to receive the wafer for processing. The spring member is disposed on the bottom section and configured to apply an electric charge to the wafer. In accordance with another aspect of the present invention, the spring member contacts a portion of the outer perimeter of the wafer. In one alternative configuration of the present invention, the wafer chuck further includes a seal member to seal the spring member from the electrolyte solution used in the electropolishing and/or electroplating process.

DESCRIPTION OF THE DRAWING FIGURES

The subject matter of the present invention is particularly pointed out and distinctly claimed in the concluding portion of the specification. The present invention, however, both as to organization and method of operation, may best be understood by reference to the following description taken in conjunction with the claims and the accompanying drawing figures, in which like parts may be referred to by like numerals:

FIGS. 7A to 7G are cross section views of various alternative configurations of a portion of the wafer chuck shown in FIG. 6;

DETAILED DESCRIPTION OF EXEMPLARY EMBODIMENTS

In order to provide a more thorough understanding of the present invention, the following description sets forth numerous specific details, such as specific material, parameters, and the like. It should be recognized, however, that such description is not intended as a limitation on the scope of the present invention, but is instead provided to enable a more full and a more complete description of the exemplary embodiments.

Additionally, the subject matter of the present invention is particularly suited for use in connection with electroplating and/or electropolishing of semiconductor workpieces or wafers. As a result, exemplary embodiments of the present invention are described in that context. It should be recognized, however, that such description is not intended as a limitation on the use or applicability of the present invention. Rather, such description is provided to enable a more full and a more complete description of the exemplary embodiments.

Figure 1:
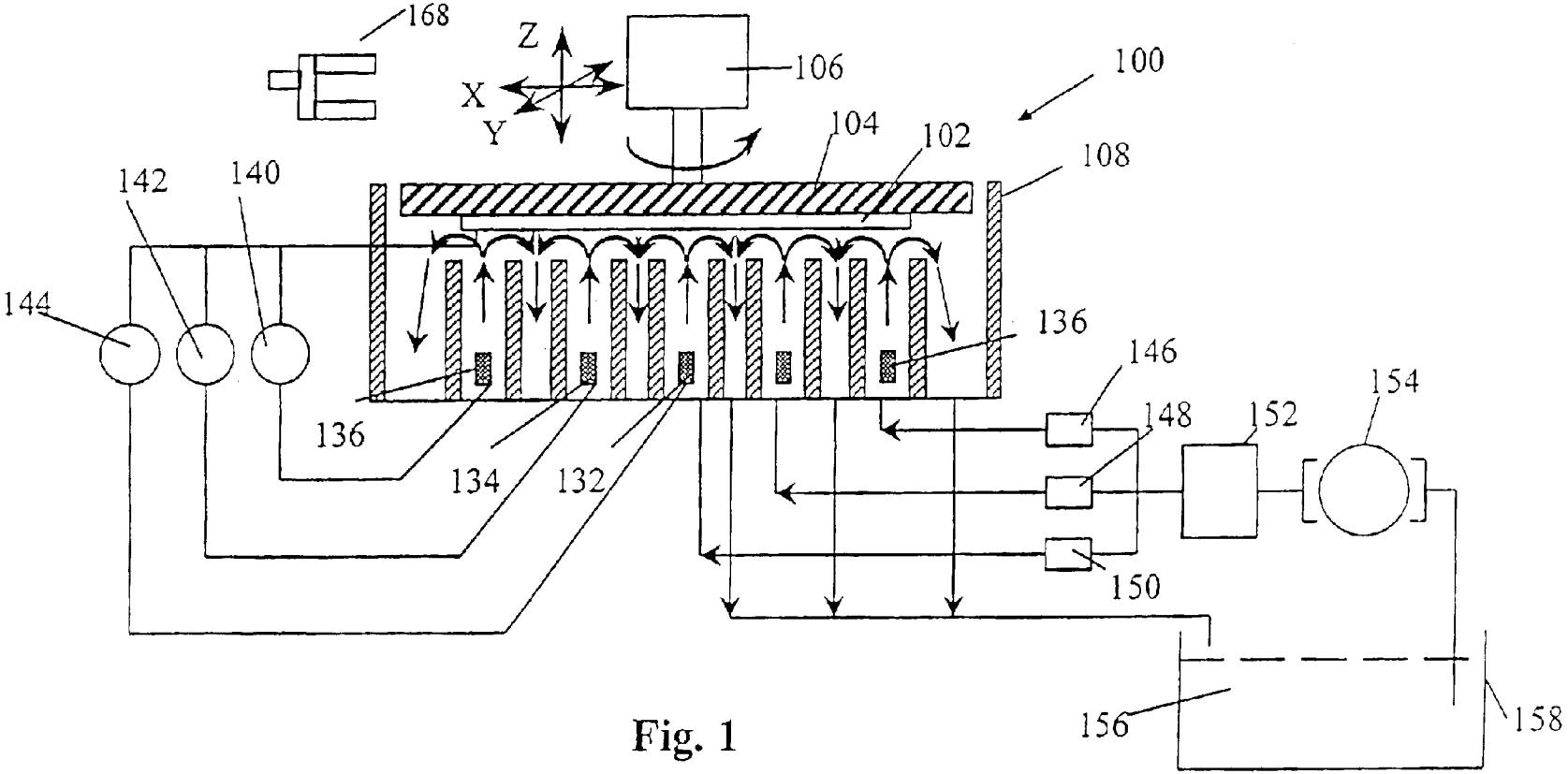
FIG. 1 is a cross section view of a semiconductor-processing tool in accordance with various aspects of the present invention.
Figure 2:
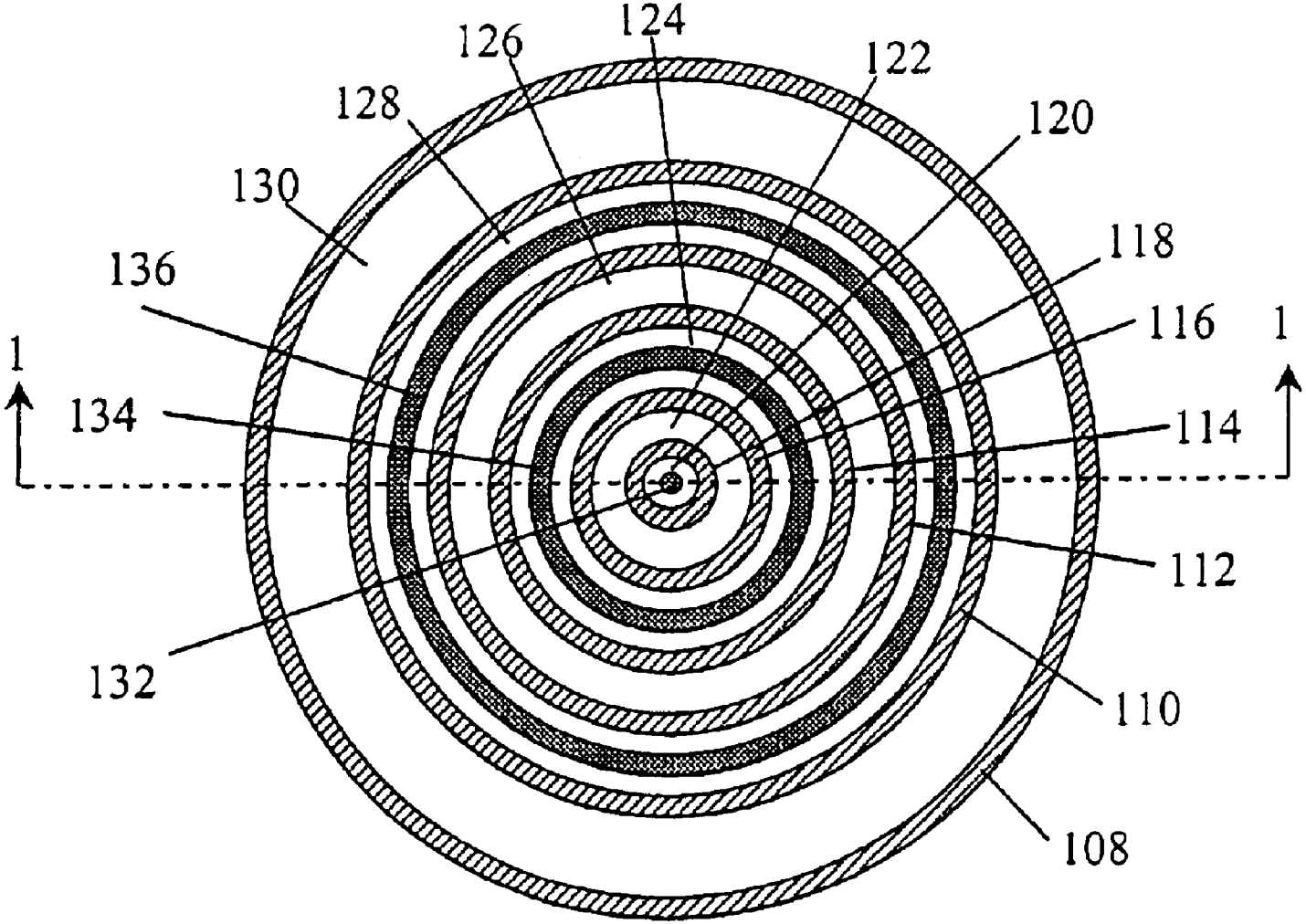
FIG. 2 is a top view of the semiconductor-processing tool shown in FIG. 1.

With reference now to FIGS. 1 and 2, a wafer electroplating and/or electropolishing tool 100, according to various aspects of the present invention, preferably includes an electrolyte solution receptacle 108 and a wafer chuck 104. In the present exemplary embodiment, with reference to FIG. 2, electrolyte solution receptacle 108 is preferably divided into sections 120, 122, 124, 126, 128 and 130 by section walls 110, 112, 114, 116 and 118. It should be recognized, however, that electrolyte solution receptacle 108 can be divided into any number of sections by any number of appropriate sections walls depending on the particular application.

With reference to FIG. 1, in the present exemplary embodiment, a pump 154 pumps an electrolyte solution 156 from a reservoir 158 into electrolyte solution receptacle 108. More particularly, electrolyte solution 156 flows through a pass filter 152 and Liquid Mass Flow Controllers (LMFCs) 146, 148 and 150. Pass filter 152 removes contaminants and unwanted particles from electrolyte solution 156. LMFCs 146, 148 and 150 control the flow of electrolyte solution 156 into sections 120, 124 and 128 (FIG. 2), respectively. It should be recognized, however, that electrolyte solution 156 can be provided using any convenient method depending on the particular application.

In the present exemplary embodiment, a robot 168 inserts or provides a wafer 102 into wafer chuck 104. Robot 168 can obtain wafer 102 from any convenient wafer cassette (not shown) or from a previous processing station or processing tool. Wafer 102 can also be loaded into wafer chuck 104 manually by an operator depending on the particular application.

As will be described in greater detail below, after receiving wafer 102, wafer chuck 104 closes to hold wafer 102. Wafer chuck 104 then positions wafer 102 within electrolyte solution receptacle 108. More particularly, in the present exemplary embodiment, wafer chuck 104 positions wafer 102 above section walls 110, 112, 114, 116 and 118 (FIG. 2) to form a gap between the bottom surface of wafer 102 and the tops of section walls 110, 112, 114, 116 and 118 (FIG. 2).

In the present exemplary embodiment, electrolyte solution 156 flows into sections 120, 124 and 128 (FIG. 2), and contacts the bottom surface of wafer 102. Electrolyte solution 156 flows through the gap formed between the bottom surface of wafer 102 and section walls 110, 112, 114, 116 and 118 (FIG. 2). Electrolyte solution 156 then returns to reservoir 158 through sections 122, 126 and 130 (FIG. 2).

As will be described in greater detail below, wafer 102 is connected to one or more power supplies 140, 142 and 144. Also, one or more electrodes 132, 134 and 136 disposed within electrolyte solution receptacle 108 are connected to power supplies 140, 142 and 144. When electrolyte solution 156 contacts wafer 102, a circuit is formed to electroplate and/or to electropolish wafer 102. When wafer 102 is electrically charged to have negative electric potential relative to electrodes 132, 134 and 136, wafer 102 is electroplated. When wafer 102 is electrically charged to have positive electric potential relative to electrodes 132, 134 and 136, wafer 102 is suitably electropolished. Additionally, when wafer 102 is electroplated, electrolyte solution 156 is preferably a sulfuric acid solution. When wafer 102 is electropolished, electrolyte solution 156 is preferably a phosphoric acid solution. It should be recognized, however, that electrolyte solution 156 can include various chemistries depending on the particular application. Additionally, wafer 102 can be rotated and/or oscillated to facilitate a more uniform electroplating and/or electropolishing of wafer 102. For a more detailed description of electropolishing and electroplating processes, see U.S. patent application Ser. No. 09/232,864, entitled PLATING APPARATUS AND METHOD, filed on Jan. 15, 1999, the entire content of which is incorporated herein by reference, and PCT patent application No. PCT/US99/15506, entitled METHODS AND APPARATUS FOR ELECTROPOLISHING METAL INTERCONNECTIONS ON SEMICONDUCTOR DEVICES, filed on Aug. 7, 1999, the entire content of which is incorporated herein by reference.

As alluded to earlier, specific details related to electroplating and/or electropolishing tool 100 have been provided above to enable a more full and a more complete description of the present invention. As such, various aspects of electroplating and/or electropolishing tool 100 can be modified without deviating from the spirit and/or scope of the present invention. For example, although electroplating and/or electropolishing tool 100 has been depicted and described as having electrolyte solution receptacle 108 with a plurality of sections, electroplating and/or electropolishing tool 100 can include a static bath.

Having thus described an exemplary electroplating and/or electropolishing tool and method, an exemplary embodiment of wafer chuck 104 will hereafter be described. As a preliminary matter, for the sake of clarity and convenience, wafer chuck 104 will hereafter be described in connection with electroplating of a semiconductor wafer. However, it should be recognized that wafer chuck 104 can be used in connection with any convenient wafer process, such as electropolishing, cleaning, etching, and the like. Additionally, it should be recognized that wafer chuck 104 can be used in connection with processing of various workpieces other than semiconductor wafers.

Figure 3:
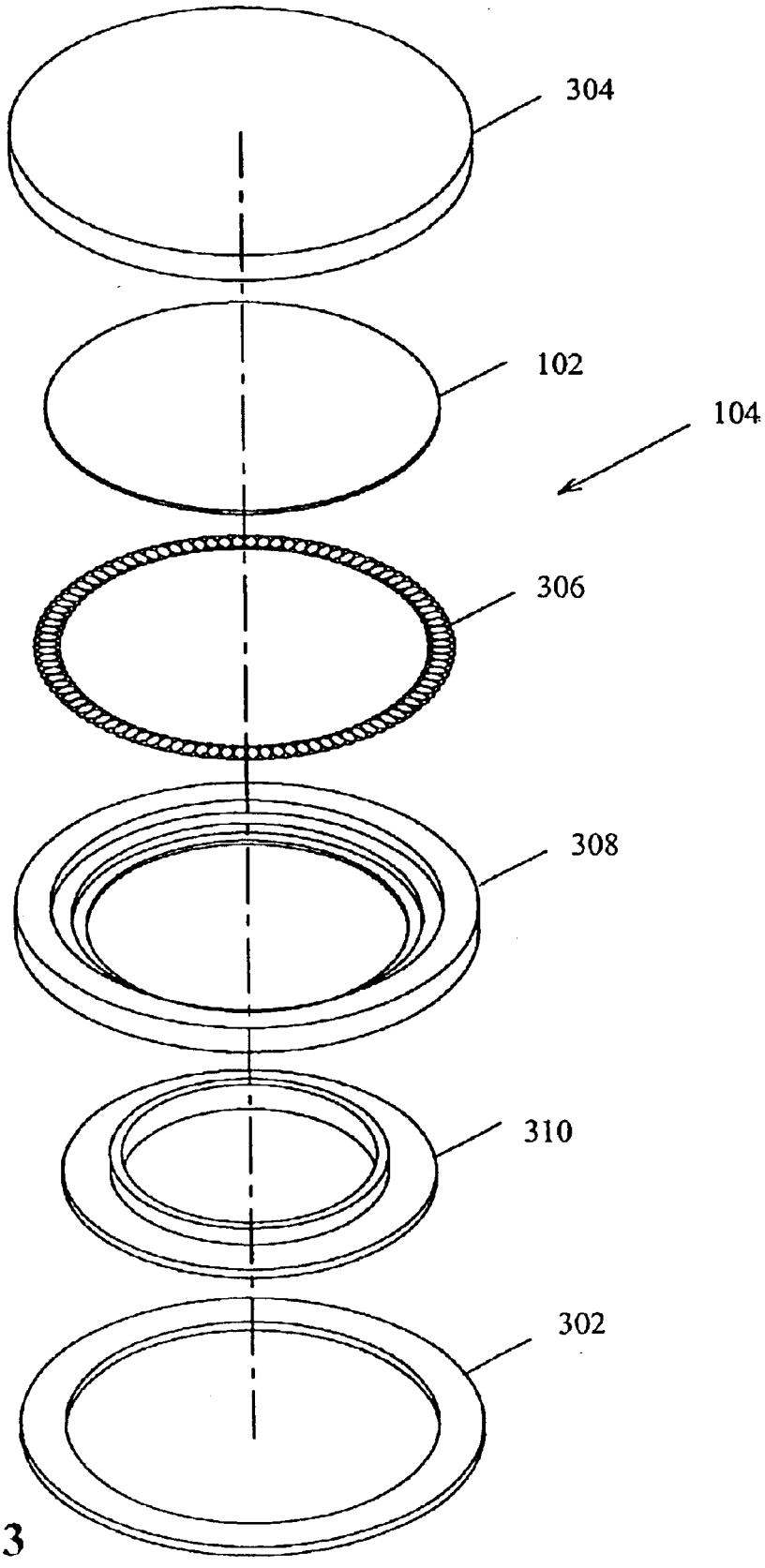
FIG. 3 is an exploded perspective view of a wafer chuck in accordance with various aspects of the present invention.

With reference now to FIG. 3, wafer chuck 104 includes a bottom section 302 and a top section 304. As will be described in greater detail below, during the electroplating process, in the present exemplary embodiment, wafer 102 is held between bottom section 302 and top section 304. In this regard, wafer chuck 104 is suitably configured to open and close for inserting and/or removing wafer 102.

Figure 21A:
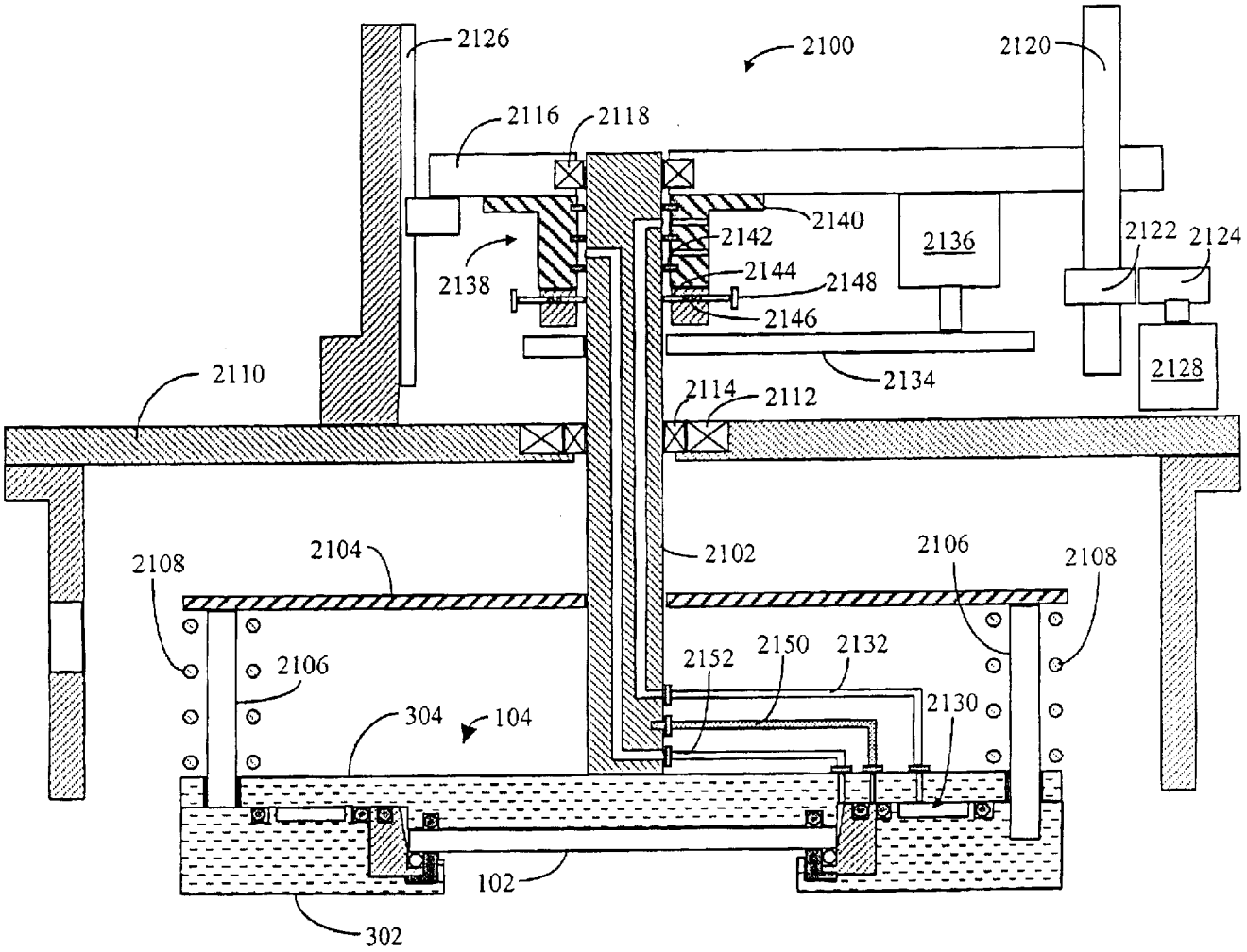
FIGS. 21A to 21C are cross section views of a wafer chuck assembly in accordance with various aspects of the present invention.
Figure 21B:
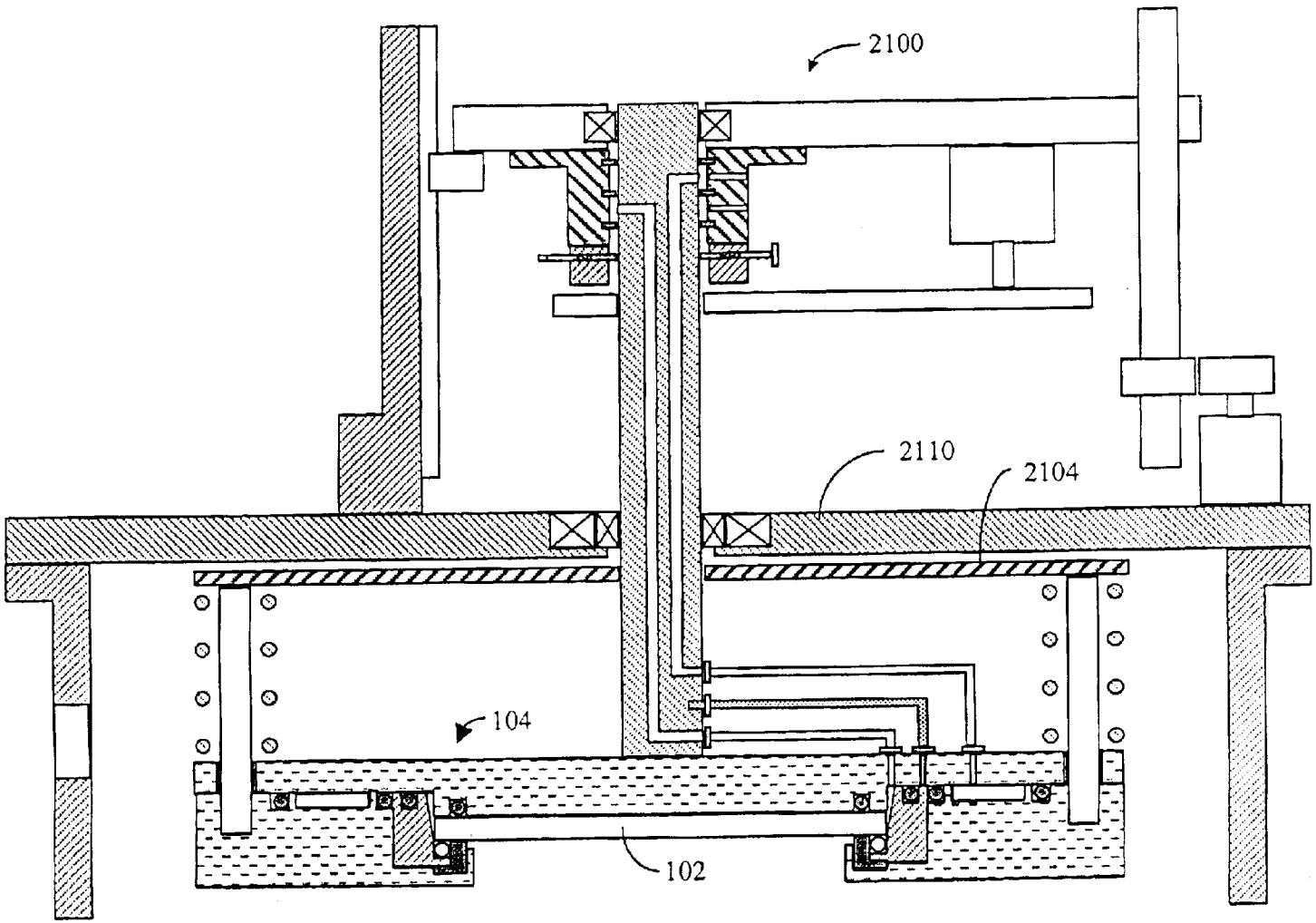
Figure 21C:
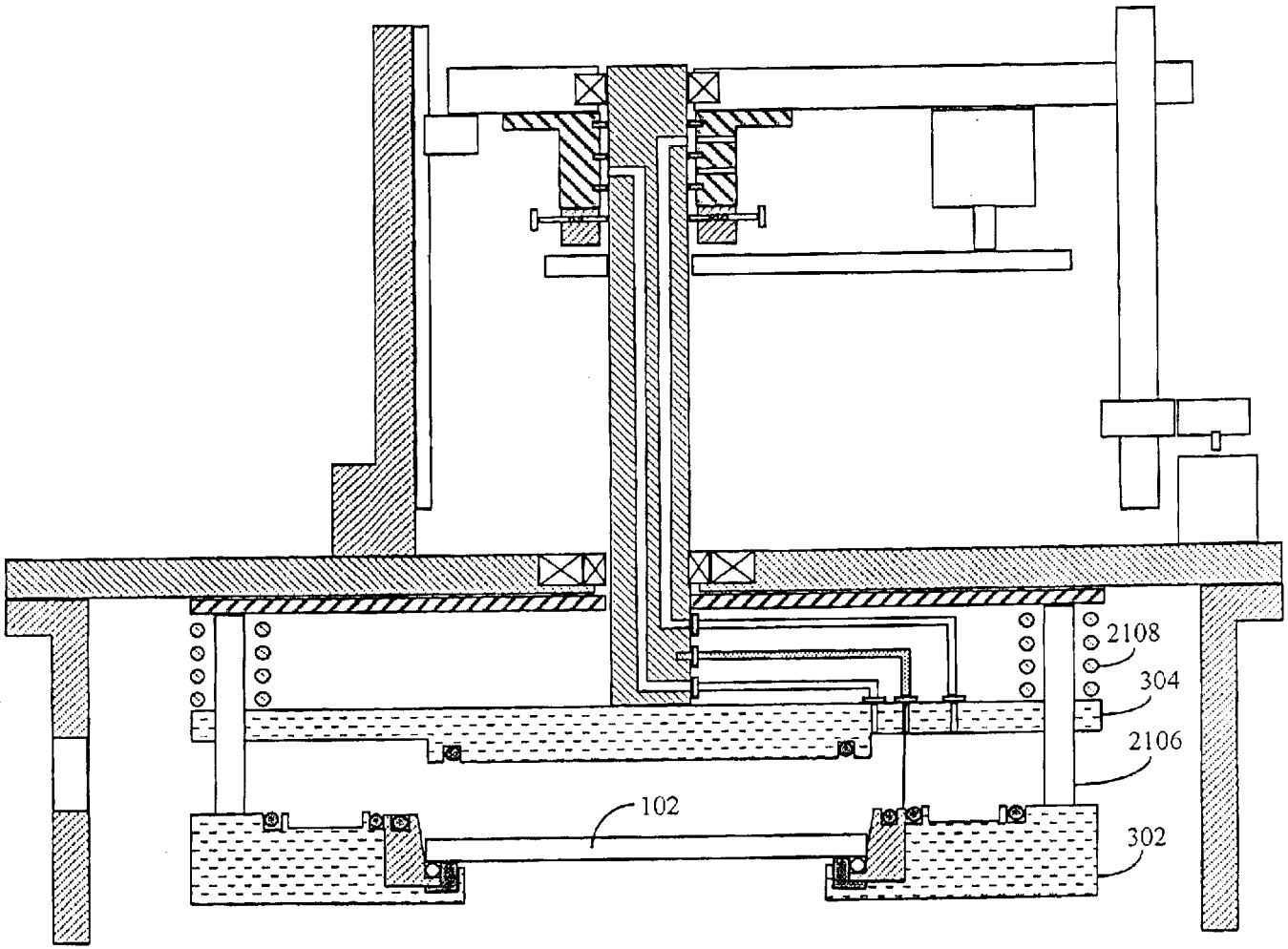

With reference to FIGS. 21A to 21C, a wafer chuck assembly 2100 suitably configured to open and close wafer chuck 104 is described below. As will be described in greater detail below, wafer chuck assembly 2100 is further configured to rotate wafer chuck 104.

In the present exemplary embodiment, wafer chuck assembly 2100 includes a shaft 2102, a collar 2104, a plurality of rods 2106, and a plurality of springs 2108. Shaft 2102 is rigidly fixed to top section 304 and mounted to a support housing 2110 through bearing 2112 and bushing 2114. Shaft 2102 is also mounted to support beam 2116 through bearing 2118. Rods 2106 are rigidly fixed to bottom section 302 and collar 2104. Collar 2104 is suitably configured to slip along shaft 2102. Springs 2108 are disposed around rods 2106.

Wafer chuck assembly 2100 also includes screw-gears 2120, gears 2122 and 2124, a guide rail 2126 for raising and lowering as well as opening and closing wafer chuck 104. More particularly, as depicted in FIG. 21A, wafer chuck 104 can be lowered into an electrolyte solution receptacle 108 (FIG. 1). In this position, springs 2108 are extended to hold closed top section 304 and bottom section 302. In accordance with another aspect of the present invention, top section 304 and bottom section 302 are held closed by a vacuum applied to vacuum chamber 2130 formed between top section 304 and bottom section 302. Vacuum can be provided from shaft 2102 through vacuum line 2132.

As depicted in FIG. 21B, wafer chuck 104 can be raised from electrolyte solution receptacle 108 (FIG. 1). As wafer chuck 104 is raised, collar 2104 contacts support housing 2110. As depicted in FIG. 21C, rods 2106 prevent bottom section 302 from rising any further, but springs 2108 compress to permit top section 304 to continue to rise. In this manner, wafer chuck 104 can be opened to remove and/or insert wafer 102.

With reference again to FIG. 21A, in accordance with another aspect of the present invention, wafer chuck assembly 2100 is suitably configured to rotate wafer chuck 104. In the present exemplary embodiment, wafer chuck assembly 2100 includes a belt wheel 2134, a motor 2136, and a slip ring assembly 2138. Belt wheel 2134 and motor 2136 rotate shaft 2102. While shaft 2102 rotates, slip ring assembly 2138 facilitates the flow of vacuum, pressure gas, and electricity into and/or out of shaft 2102. In the present exemplary embodiment, slip ring assembly 2138 includes a ring base 2140, seals 2142, a brush 2144, springs 2146, and screws 2148. Seals 2142 can be formed from a low friction material such as polytetrafluoroethylene (commercially known as TEFLON). Seals 2142 also can be formed from a variety of spring loaded seals available from Bay Seal Engineering Company, Incorporated of Foothill Ranch, Calif. Brush 2144 can be formed from an electrically conducting and low friction material, such as graphite. Shaft 2102 is formed from a metal or metal alloy resistant to corrosion, such as stainless steel. In accordance with one aspect of the present embodiment, in order to reduce friction, the surface of shaft 2102 contacting seals 2142 and brush 2144 is machined to a surface roughness less than about 5 micron, and preferably less than about 2 micron.

It should be recognized that wafer chuck 104 can be opened and closed, raised and lowered, and rotated using any convenient apparatus and method. For example, wafer chuck 104 can be opened and closed using pneumatic actuators, magnetic forces, and the like. Also see U.S. Provisional Application Ser. No. 60/110,134, entitled METHOD AND APPARATUS FOR CHUCKING WAFER IN ELECTROPLATING, filed on Nov. 28, 1998, the entire content of which is incorporated herein by reference.

With reference again to FIG. 3, bottom section 302 and top section 304 are formed from any convenient material electrically insulated and resistant to acid and corrosion, such as ceramic, polytetrafluoroethylene (commercially known as TEFLON), PolyVinyl Choride (PVC), PolyVinylindene Fluoride (PVDF), Polypropylene, and the like. Alternatively, bottom section 302 and top section 304 can be formed from any electrically conducting material (such as metal, metal alloy, and the like), coated with material, which is electrically insulating and resistant to acid and corrosion.

Figure 22:
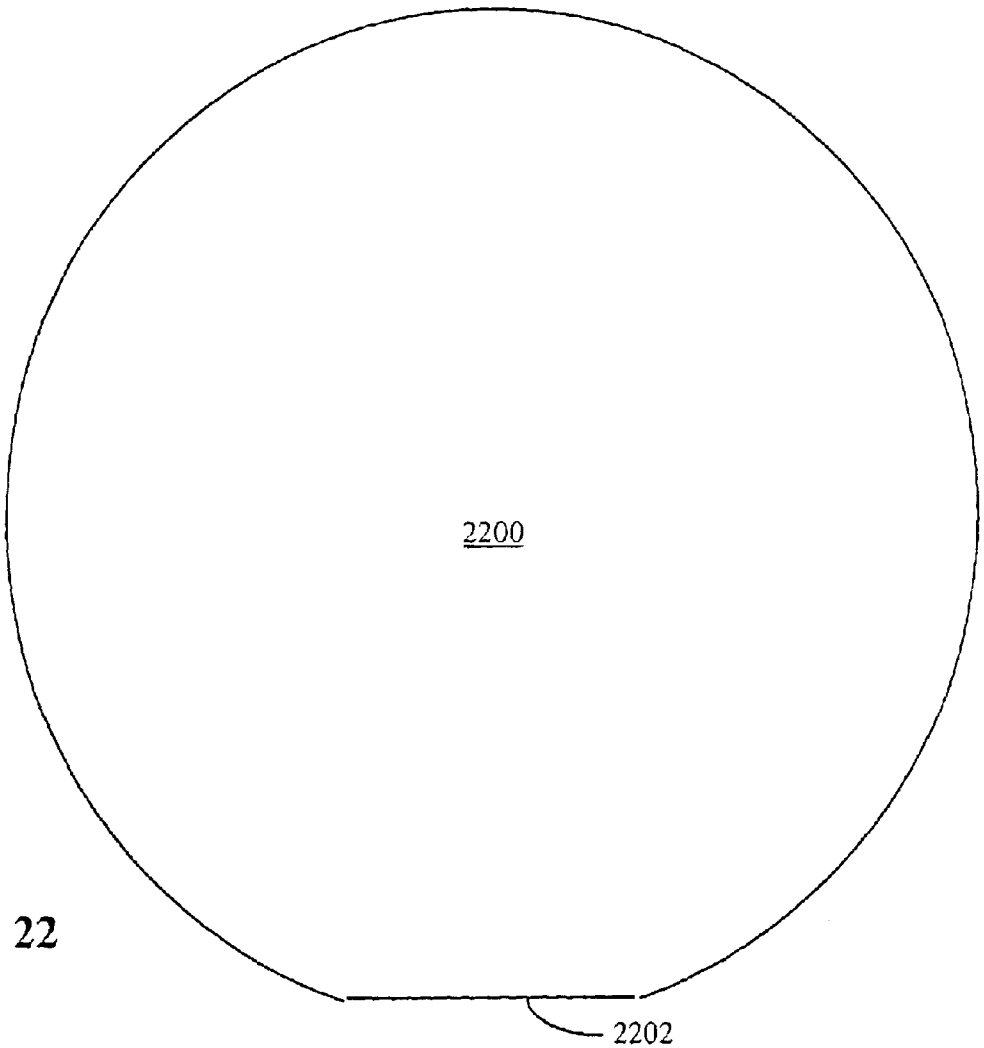
FIG. 22 is a top view of a wafer in accordance with various aspects of the present invention.

Wafer chuck 104 according to various aspects of the present invention further includes a spring member 306, a conducting member 308, and a seal member 310. As alluded to earlier, the present invention is particular well suited for use in connection with holding semiconductor wafers. In general, semiconductor wafers are substantially circular in shape. Accordingly, the various components of wafer chuck 104 (i.e., bottom section 302, seal member 310, conducting member 308, spring member 306, and top section 304) are depicted as having substantially circular shape. It should be recognized, however, that the various components of wafer chuck 104 can include various shapes depending on the particular application. For example, with reference to FIG. 22, wafer 2200 can be formed with a flat edge 2202. Thus, the various components of wafer chuck 104 can be formed to conform with flat edge 2202.

Figure 5:
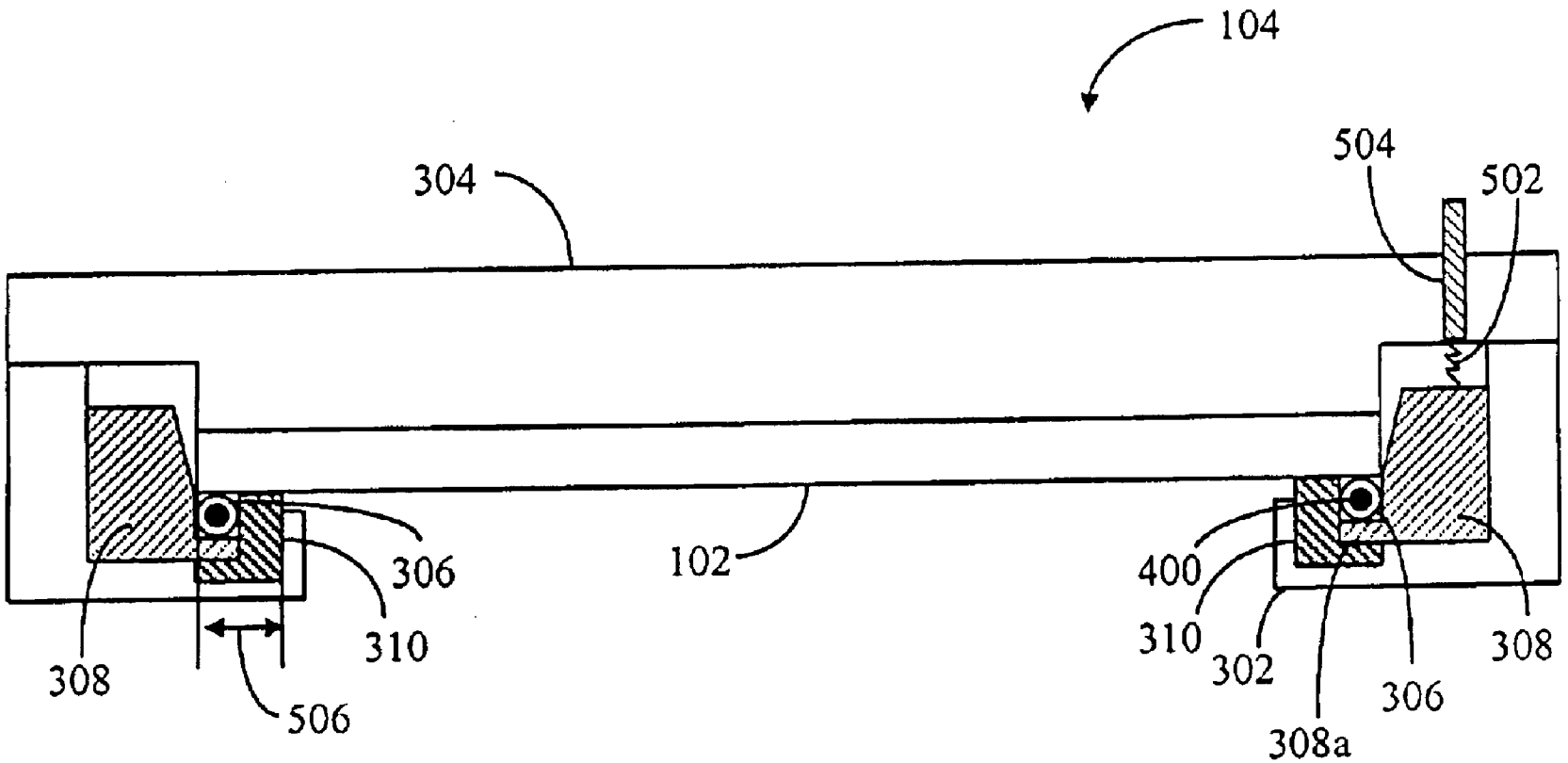
FIG. 5 is a cross section view of the wafer chuck shown in FIG. 4.

With reference now to FIG. 5, when wafer 102 is disposed between bottom section 302 and top section 304, in accordance with one aspect of the present invention, spring member 306 preferably contacts wafer 102 around the outer perimeter of wafer 102. Spring member 306 also preferably contacts conducting member 308. Thus, when an electric charge is applied to conducting member 308, the electric charge is transmitted to wafer 102 through spring member 306.

As depicted in FIG. 5, in the present exemplary embodiment, spring member 306 is disposed between wafer 102 and lip portion 308*a* of conducting member 308. Accordingly, when pressure is applied to hold bottom section 302 and top section 304 together, spring member 306 conforms to maintain electrical contact between wafer 102 and conducting member 308. More particularly, the tops and bottoms of the coils in spring member 306 contact wafer 102 and lip portion 308*a*, respectively. Additionally, spring member 306 can be joined to lip portion 308*a* to form a better electrical contact using any convenient method, such as soldering, welding, and the like.

The number of contact points formed between wafer 102 and conducting member 308 can be varied by varying the number of coils in spring member 306. In this manner, the electric charge applied to wafer 102 can be more evenly distributed around the outer perimeter of wafer 102. For example, for a 200 millimeter (mm) wafer, an electric charge having about 1 to about 10 amperes is typically applied. If spring member 306 forms about 1000 contact points with wafer 102, then for the 200 mm wafer, the applied electric charge is reduced to about 1 to about 10 milli-amperes per contact point.

In the present exemplary embodiment, conducting member 308 has been thus far depicted and described as having a lip section 308*a*. It should be recognized, however, that conducting member 308 can include various configurations to electrically contact spring member 306. For example, conducting member 308 can be formed without lip section 308*a*. In this configuration, electrical contact can be formed between the side of conducting member 308 and spring member 306. Moreover, conducting member 308 can be removed altogether. An electric charge can be applied directly to spring member 306. However, in this configuration, hot spots can form in the portions of spring member 306 where the electric charge is applied.

Spring member 306 can be formed from any convenient electrically conducting, and corrosion-resistant material. In the present exemplary embodiment, spring member 306 is formed from a metal or metal alloy (such as stainless steel, spring steel, titanium, and the like). Spring member 306 can also be coated with a corrosion-resistant material (such as platinum, gold, and the like). In accordance with one aspect of the present invention, spring member 306 is formed as a coil spring formed in a ring. However, conventional coil springs typically have cross sectional profiles, that can vary throughout the length of the coil. More specifically, in general, conventional coil springs have elliptical cross-sectional profiles, with a long diameter and a short diameter. In one part of the coil spring, the long and short diameters of the elliptical cross-sectional profile can be oriented vertically and horizontally, respectively. However, this elliptical cross-sectional profile typically twists or rotates along the length of the coil spring. Thus, in another part of the coil spring the long and short diameters of the elliptical cross-sectional profile can be oriented horizontally and vertically, respectively. This nonuniformity in the cross-sectional profile of the coil spring can result in nonuniform electrical contact with wafer 102 and thus nonuniform electroplating.

A coil spring having a uniform cross-sectional profile throughout its length can be difficult to produce and cost prohibitive. As such, in accordance with one aspect of the present invention, spring member 306 is formed from a plurality of coil springs to maintain a substantially uniform cross sectional profile. In one configuration of the present embodiment, when spring member 306 is disposed on top of lip portion 308*a*, the applied electric charge is transmitted from lip portion 308*a* throughout the length of spring member 306. Accordingly, in this configuration, the plurality of coil springs need not be electrically joined. However, as alluded to earlier, in another configuration of the present invention, the electric charge can be applied directly to spring member 306. In this configuration, the plurality of coil springs is electrically joined using any convenient method, such as soldering, welding, and the like. In the present embodiment, spring member 306 includes a plurality of coil springs, each coil spring having a length of about 1 to about 2 inches. It should be recognized, however, that spring member 306 can include any number of coil springs having any length depending on the particular application. Moreover, as alluded to earlier, spring member 306 can include any convenient conforming and electrically conducting material.

Figure 4:
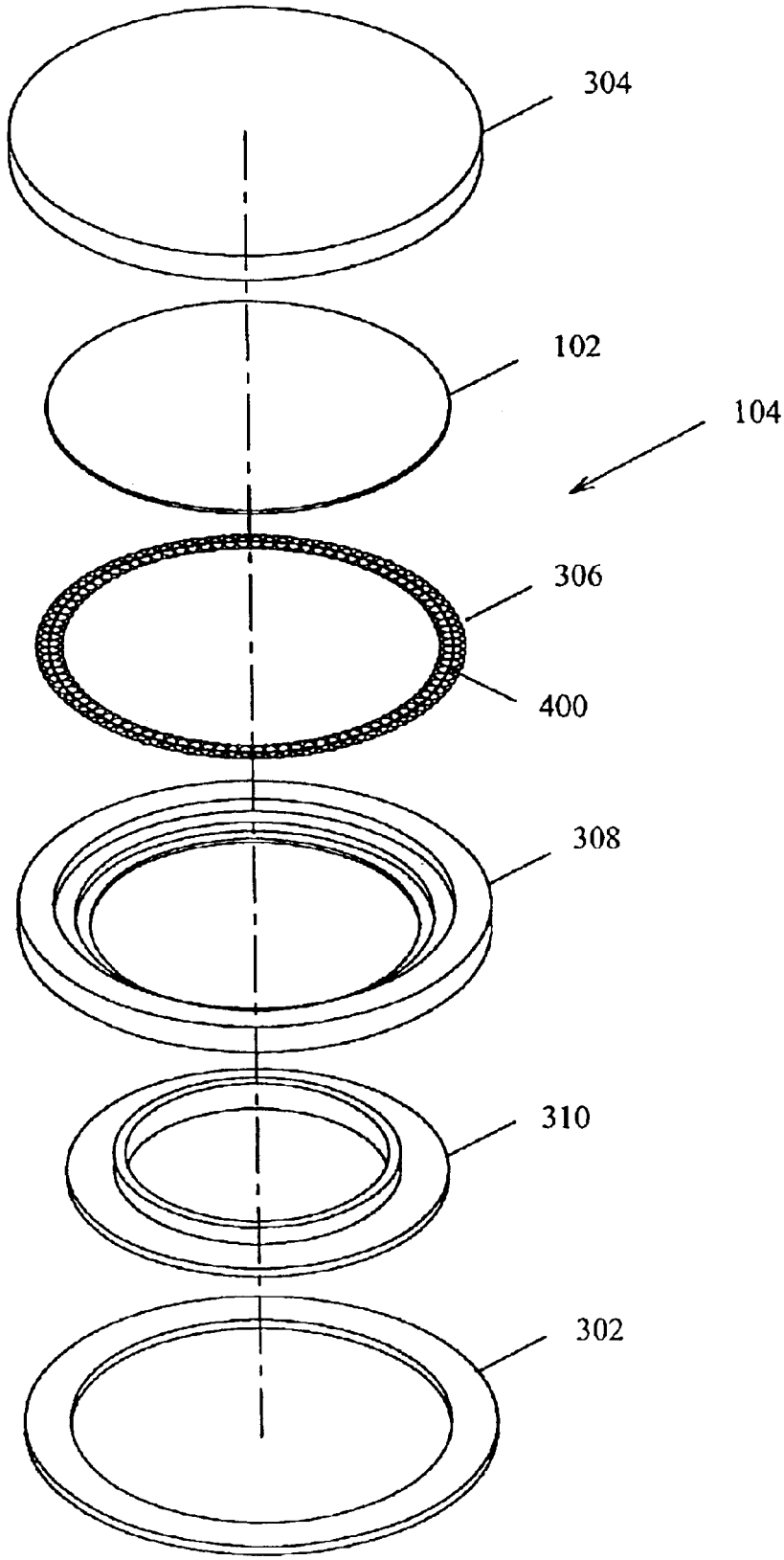
FIG. 4 is an exploded perspective view of another configuration of the wafer chuck shown in FIG. 3.

With reference to FIGS. 4 and 5, spring member 306 can include a spring holder 400. In the present exemplary embodiment, when spring member 306 is a coil spring, spring holder 400 is configured as a rod that passes through the center of the loops of the coil spring. Spring holder 400 facilitates the handling of spring member 306, particularly when spring member 306 includes a plurality of coil springs. Additionally, spring holder 400 provides structural support to reduce undesired deformation of spring member 306. In the present exemplary embodiment, spring holder 400 is preferably formed from a rigid material (such as metal, metal alloy, plastic, and the like). Additionally, spring holder 400 is preferably formed from a corrosion resistant material (such as platium, titanium, stainless steel, and the like). Furthermore, spring holder 400 can be electrically conducting or non-conducting.

Conducting member 308 can be formed from any convenient electrically conducting and corrosion-resistant material. In the present exemplary embodiment, conducting member 308 is formed from a metal or metal alloy (such as titanium, stainless steel, and the like) and coated with corrosion-resistant material (such as platinum, gold, and the like).

An electric charge can be applied to conducting member 308 through transmission line 504 and electrode 502. It should be recognized that transmission line 504 can include any convenient electrically conducting medium. For example, transmission line 504 can include electric wire formed from copper, aluminum, gold, and the like. Additionally, transmission line 504 can be connected to power supplies 104, 142 and 144 (FIG. 1) using any convenient method. For example, as depicted in FIG. 5, transmission line 504 can be run through top section 304 and along the top surface of top section 304. Alternatively, transmission line 504 can be run through top section 304. Transmission line 504 can then be connected to lead 2150 (FIG. 21A).

Electrode 502 is preferably configured to be compliant. Accordingly, when pressure is applied to hold bottom section 302 and top section 304 together, electrode 502 conforms to maintain electric contact with conducting member 308. In this regard, electrode 502 can include a leaf spring assembly, a coil spring assembly, and the like. Electrode 502 can be formed from any convenient electrically conducting material (such as any metal, metal alloy, and the like). In the present exemplary embodiment, electrode 502 is formed from anti-corrosive material (such as titanium, stainless steel, and the like). Additionally, any number of electrodes 502 can be disposed around top section 304 to apply an electric charge to conducting member 308. In the present exemplary embodiment, four electrodes 502 are disposed approximately equally spaced at an interval of about 90 degrees around top section 304.

As described above, to electroplate a metal layer, wafer 102 is immersed in an electrolyte solution and an electric charge is applied to wafer 102. When wafer 102 is electrically charged with a potential greater than electrodes 132, 134 and 136 (FIG. 1), metal ions within the electrolyte solution migrate to the surface of wafer 102 to form a metal layer. However, when the electric charge is applied, shorting can result if spring member 306 and/or conducting member 308 are exposed to the electrolyte solution. Additionally, during an electroplating process when wafer 102 includes a seed layer of metal, the metal seed layer can act as an anode and spring member 306 can act as a cathode. As such, a metal layer can form on spring member 306 and the seed layer on wafer 102 can be electropolished (i.e., removed). The shorting of spring member 306 and the removal of the seed layer on wafer 102 can reduce the uniformity of the metal layer formed on wafer 102.

Thus, in accordance with various aspects of the present invention, seal member 310 isolates spring member 306 and conducting member 308 from the electrolyte solution. Seal member 310 is preferably formed from anti-corrosive material, such as Viton (fluorocarbon) rubber, silicone rubber, and the like. Also, although in the present exemplary embodiment depicted in FIG. 5, seal member 310 includes an L-shaped profile, it should be recognized that seal member 310 can include various shapes and configurations depending on the particular application. Some examples of the various configurations of seal member 310 are depicted in FIGS. 7A to 7G. However, it should be recognized that the various configurations depicted in FIGS. 7A to 7G are only exemplary and not intended to show each and every possible alternative configuration of seal member 310.

As describe above and as depicted in FIG. 5, spring member 306 and seal member 310 contact wafer 102 around the outer perimeter of wafer 102. More particularly, spring member 306 and seal member 310 contact a width 506 of the outer perimeter of wafer 102. In general, this area of wafer 102 cannot be used to later form microelectronic structure and the like. As such, in accordance with one aspect of the present invention, width 506 is maintained at a small ratio of the overall surface area of wafer 102. For example, for about a 300 millimeter (mm) wafer, width 506 is kept between about 2 mm to about 6 mm. It should be recognized, however, that width 506 can be any ratio of the overall surface area of wafer 102 depending on the particular application. For example, in one application, the amount of metal layer deposited on wafer 102 can be more important than the usable area of wafer 102. As such, a large portion of the surface area of wafer 102 can be dedicated to contacting spring member 306 and sealing member 310 to receive a large applied charge.

Figure 6A:
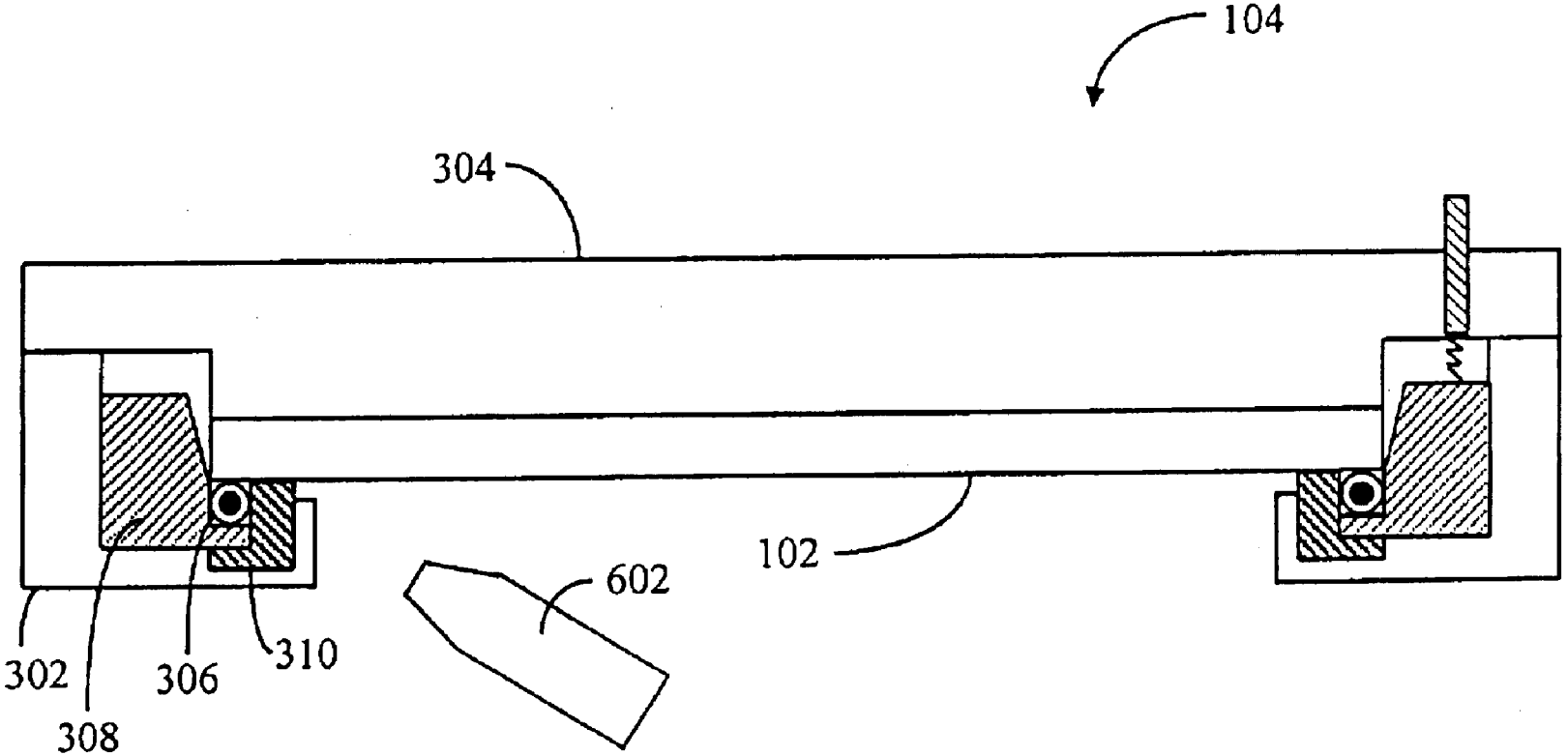
FIGS. 6A and 6B are cross section views of the wafer chuck shown in FIG. 4 in accordance with various aspects of the present invention.
Figure 6B:
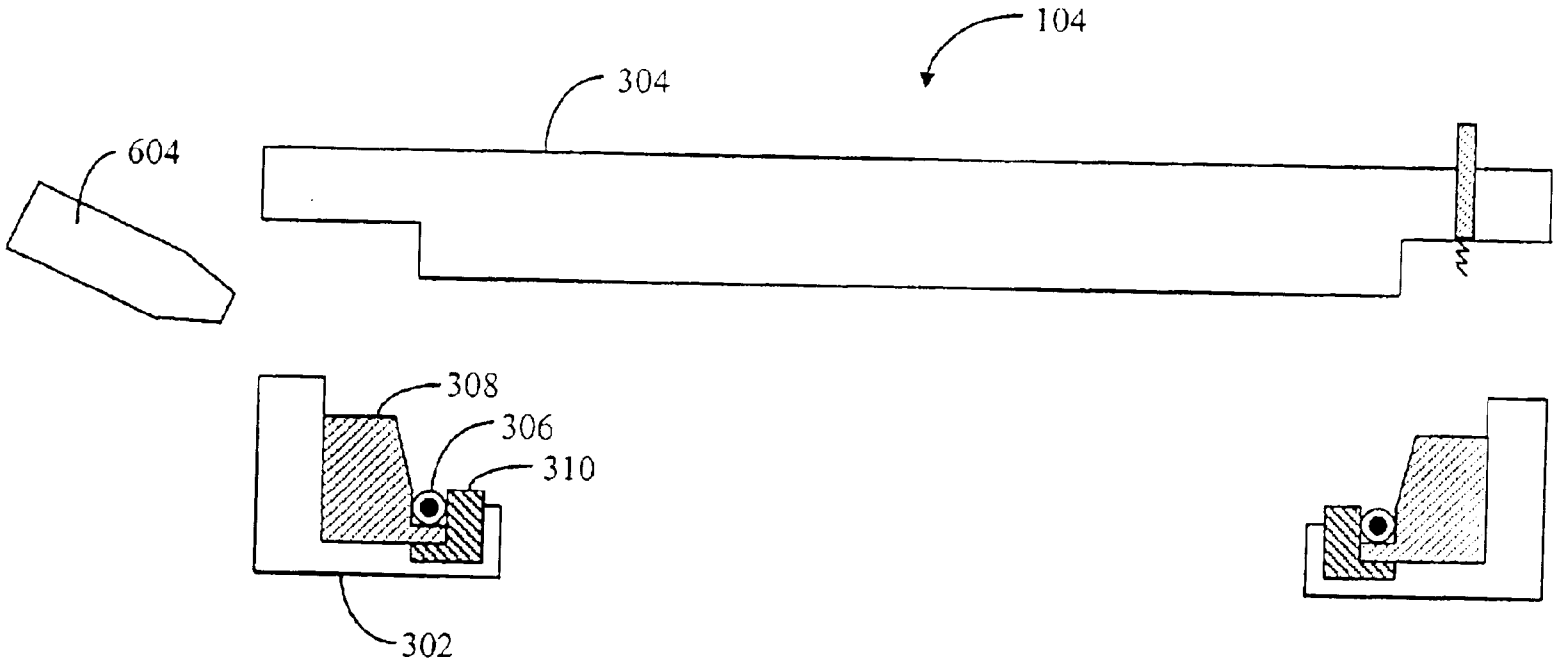
Figure 8:
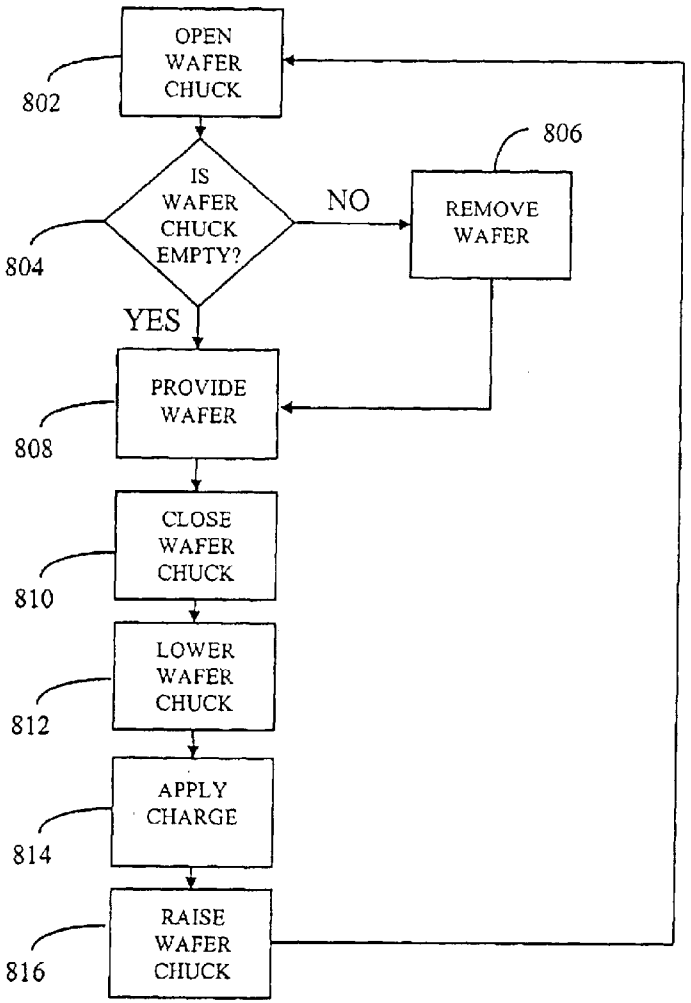
FIG. 8 is a flow chart for handling wafers in accordance with various aspects of the present invention.

With reference now to FIG. 8, the processing steps performed by wafer chuck 104 (FIG. 6) are set forth in a flow chart format. With reference to FIG. 5, wafer chuck 104 is opened (FIG. 8, block 802) to receive a wafer 102 to be processed. More particularly, bottom section 302 can be lowered relative to top section 304. Alternatively, top section 304 can be raised relative to bottom section 302. As alluded to earlier, various methods can be used to open wafer chuck 104, such as pneumatics, springs, vacuum, magnetics, and the like.

If wafer chuck 104 is empty (FIG. 8, YES branch on Decision Block 804 to Block 808), then a new wafer 102, which is to be processed, is provided or inserted (FIG. 8, block 808). However, if wafer chuck 104 contains a wafer, which has been previously processed, then the previously processed wafer is removed from wafer chuck 104 (FIG. 8, NO branch on Decision Block 804 to Block 806), then the new wafer 102 is provided (FIG. 8, block 808. As described above, the handling of wafer 102 can be performed by a robot 168 (FIG. 1). Also, wafer 102 can be obtained from a wafer cassette (not shown) and returned to the wafer cassette (not shown).

After wafer 102 is provided within wafer chuck 104, wafer chuck 104 can be closed (FIG. 8, block 810). As alluded to above, bottom section 302 can be raised relative to top section 304. Alternatively, top section 304 can be lowered relative to bottom section 304. As described above, when wafer chuck 104 is closed, spring member 306 forms an electrical contact with wafer 102 and conducting member 308. Additionally, conducting member 308 forms an electrical contact with electrode 502.

After wafer chuck 104 is closed, wafer chuck 104 is lowered (FIG. 8, block 812) within electrolyte solution receptacle 108 (FIG. 1). As described above, wafer 102 is then immersed in an electrolyte solution. Also, as described above, seal member 310 prevents the electrolyte solution from coming into contact with spring member 306 and conducting member 308.

When wafer 102 is immersed in the electrolyte solution, an electric charge is applied to wafer 102 (FIG. 8, block 814). More particularly, in the present exemplary embodiment, an electric charge is applied to wafer 102 through transmission line 504, conductor 502, conducting member 308, and spring member 306. As described above, spring member 306 forms a plurality of contact points around the outer perimeter of wafer 102 to facilitate a more even distribution of the electric charge applied to wafer 102. Additionally, as described above, spring member 306 forms a plurality of contact points with conducting member 308 to facilitate a more even distribution of the electric charge applied to spring member 306. It should be recognized that the electric charge can be applied either before or after wafer chuck 102 is lowered into electrolyte solution receptacle 108 (FIG. 1).

As alluded to earlier, wafer chuck 104 can be rotated to facilitate a more even electroplating of the metal layer on wafer 102 (FIG. 1). As depicted in FIG. 1, in the present exemplary embodiment, wafer chuck 104 can be rotated about the z-axis. Additionally, wafer chuck 104 can be oscillated in the x-y plane.

With reference again to FIG. 5, after wafer 102 has been electroplated and/or electropolished, wafer chuck 104 can then be raised (FIG. 8, block 816) from electrolyte solution receptacle 108 (FIG. 1). In accordance with another aspect of the present invention, a dry gas (such as argon, nitrogen, and the like) is applied to remove residual electrolyte solution. More particularly, with reference to FIG. 6A, the dry gas is applied through nozzle 602 to remove residual electrolyte from the joint between seal member 310 and wafer 102. It should be recognized that any number of nozzles 602 can be used depending on the particular application. Additionally, wafer chuck 104 can be rotated while the dry gas is applied through nozzle 602. As such, nozzle 602 can be fixed or moveable.

After wafer chuck 104 has been raised, wafer chuck 104 is opened (FIG. 8, block 802). The processed wafer is then removed (FIG. 8, NO branch on Decision Block 804 to Block 806). A dry gas (such as argon, nitrogen, and the like) can be applied to remove residual electrolyte solution. More particularly, with reference to FIG. 6B, the dry gas is applied through nozzle 604 to remove residual electrolyte from conducting member 308, spring member 306, and seal member 310. Additionally, wafer chuck 104 can be rotated while the dry gas is applied through nozzle 604. As such, nozzle 604 can be fixed or moveable.

After a new wafer is provided (FIG. 8, block 808), the entire process can be repeated. It should be recognized, however, that various modifications can be made to the steps depicted in FIG. 8 without deviating from the spirit and scope of the present invention.

In the following description and associated drawing figures, various alternative embodiments in accordance with various aspects of the present invention will be described and depicted. It should be recognized, however, that these alternative embodiments are not intended to demonstrate all of the various modifications, which can be made to the present invention. Rather, these alternative embodiments are provided to demonstrate only some of the many modifications, which are possible without deviating from the spirit and/or scope of the present invention.

Figure 9:
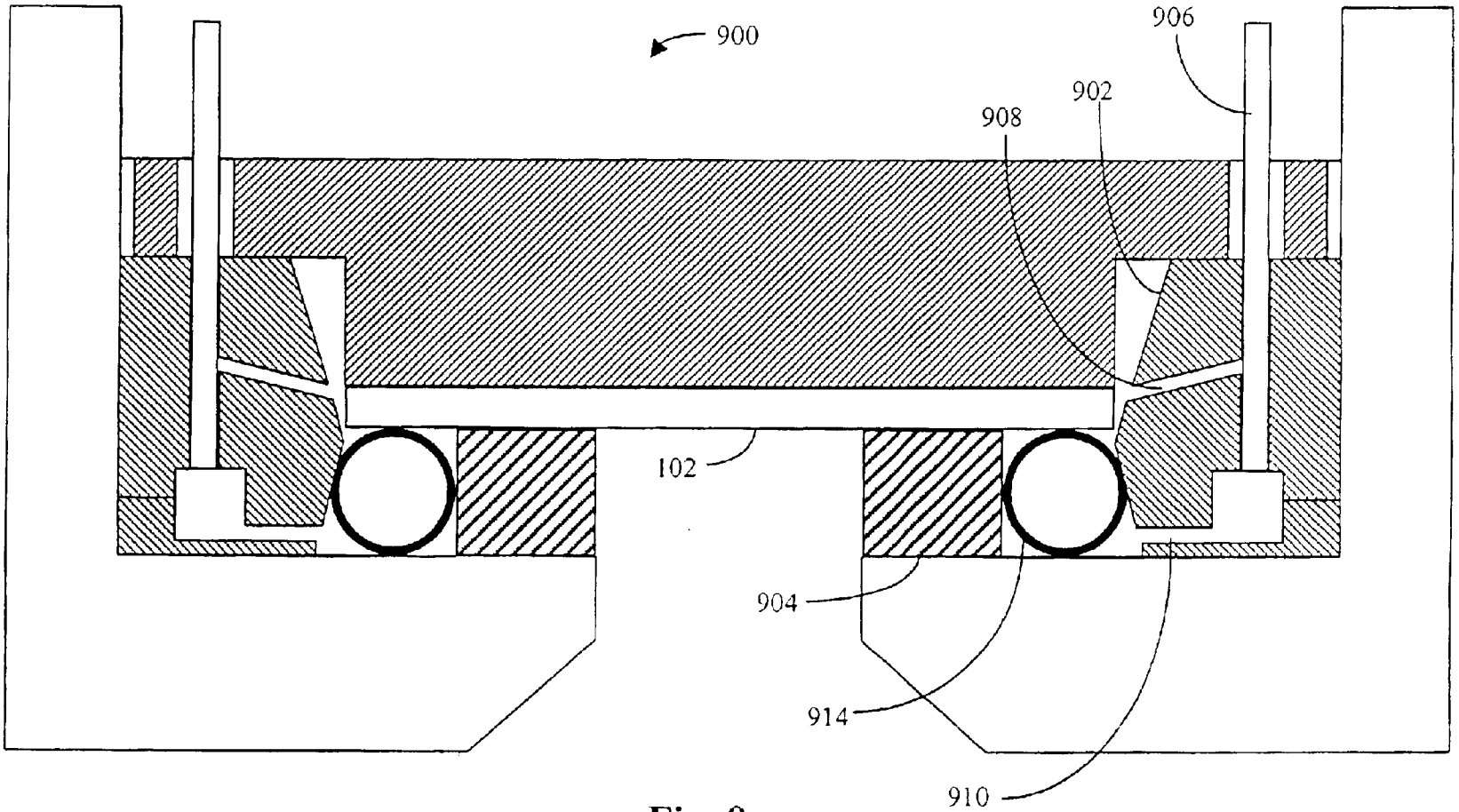
FIG. 9 is a cross section view of an alternative embodiment of the present invention.

With reference now to FIG. 9, in an alternative exemplary embodiment of the present invention, a wafer chuck 900 according to various aspects of the present invention includes a purge line 906, a nozzle 908 and a nozzle 910. In the present exemplary embodiment, purge line 906 and nozzles 908 and 910 inject a dry gas (such as argon, nitrogen, and the like) onto spring member 914 and seal member 904. In this manner, after wafer 102 is processed, residual electrolyte can be purged from spring member 914 and seal member 904. As described above, maintaining spring member 914 free of electrolyte solution facilitates a more uniform electroplating process. Additionally, purging electrolyte solution from seal member 904 facilitates a better seal when the next wafer is processed. As depicted in FIG. 9, in the present exemplary embodiment, purge line 906 and nozzles 908 and 910 are formed in conducting member 902. Additionally, purge line 906 can be connected to pressure line 2152 (FIG. 21A). It should be recognized, however, that wafer chuck 900 can be suitably configured with purge line 906 and nozzles 908 and 910 in a variety of manners without deviating from the spirit and/or scope of the present invention. Furthermore, it should be recognized that any number of purge lines 906, nozzles 908 and nozzles 910 can be formed in wafer chuck 900.

Figure 10:
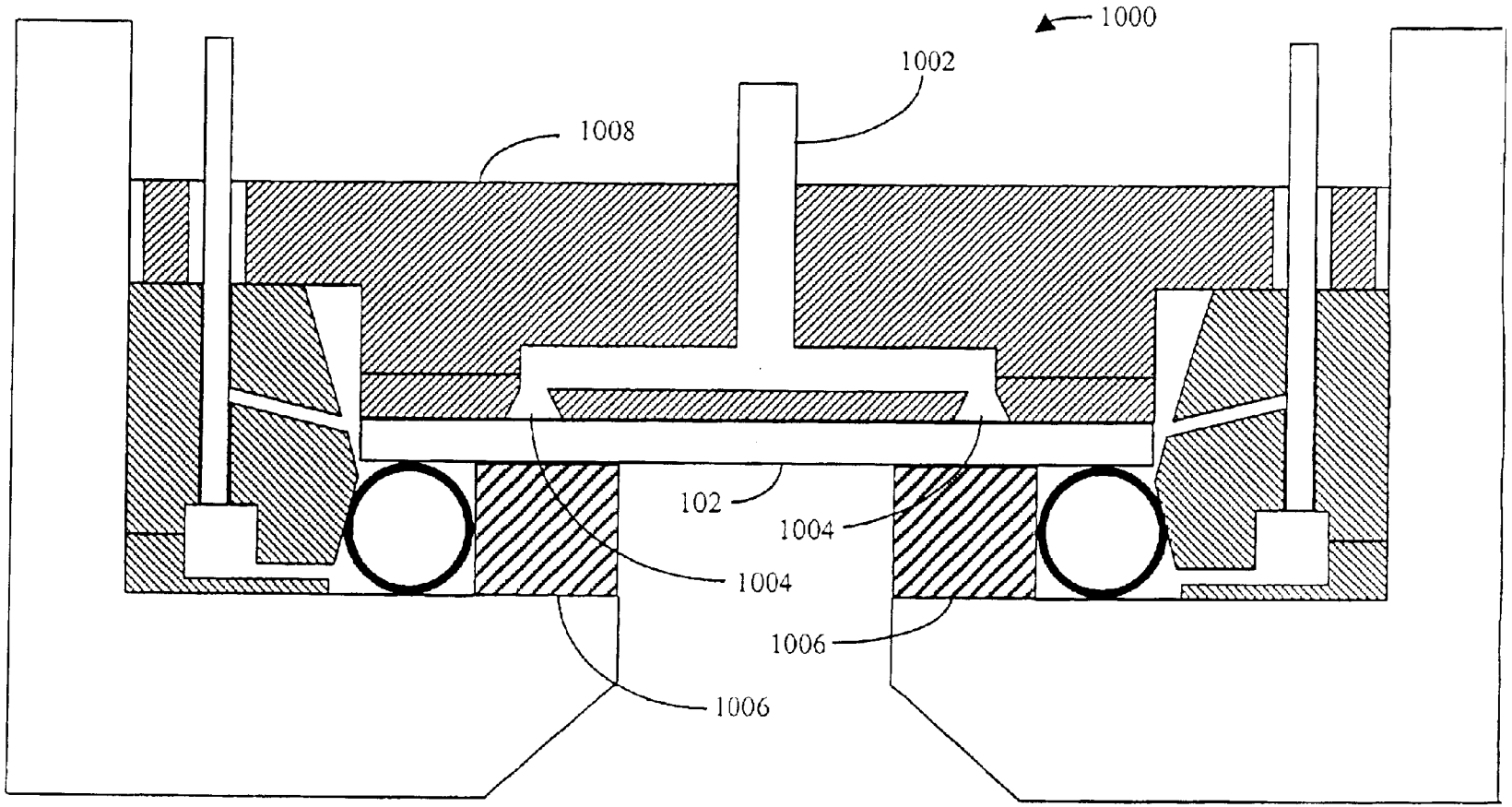
FIG. 10 is a cross section view of a second alternative embodiment of the present invention.

With reference now to FIG. 10, in another alternative exemplary embodiment of the present invention, a wafer chuck 1000 according to various aspects of the present invention includes a purge line 1002 and a plurality of nozzles 1004. In the present exemplary embodiment, purge line 1002 and plurality of nozzles 1004 inject a dry gas (such as argon, nitrogen, and the like) onto seal member 1006. In this manner, after wafer 102 is processed and removed from wafer chuck 1000, residual electrolyte can be purged from the top of seal member 1006. As depicted in FIG. 10, in the present exemplary embodiment, purge line 1002 and plurality of nozzles 1004 are formed in top section 1008. It should be recognized, however, that wafer chuck 1000 can be suitably configured in a variety manner with purge line 1002 and plurality of nozzles 1004 without deviating from the spirit and/or scope of the present invention. Furthermore, it should be recognized that any number of purge lines 1002 and nozzles 1004 can be formed in wafer chuck 1000.

Figure 11:
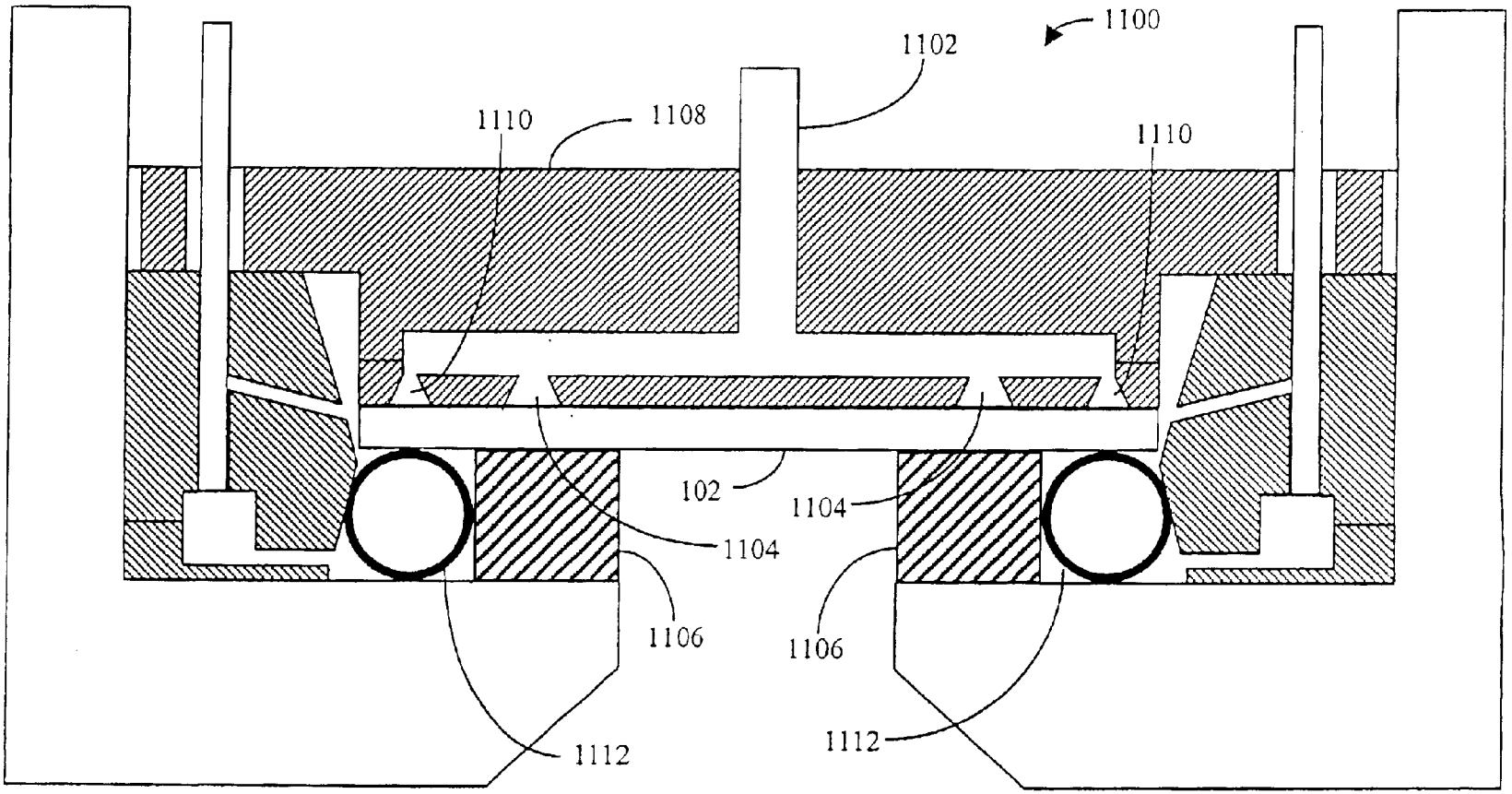
FIG. 11 is a cross section view of a third alternative embodiment of the present invention.

With reference now to FIG. 11, in still another alternative exemplary embodiment of the present invention, a wafer chuck 1100 according to various aspects of the present invention includes a purge line 1102 and a plurality of nozzles 1104 and 1110. In the present exemplary embodiment, purge line 1102 and plurality of nozzles 1104 and 1110 inject a dry gas (such as argon, nitrogen, and the like) onto seal member 1106 and spring member 1112, respectively. In this manner, after wafer 102 is processed and removed from wafer chuck 1100, residual electrolyte can be purged from the tops of seal member 1106 and spring member 1112. As depicted in FIG. 11, in the present exemplary embodiment, purge line 1102 and plurality of nozzles 1104 and 1110 are formed in top section 1108. It should be recognized, however, that wafer chuck 1100 can be suitably configured in a variety of manners with purge line 1102 and plurality of nozzles 1104 and 1110 without deviating from the spirit and/or scope of the present invention. Furthermore, it should be recognized that any number of purge lines 1102 and nozzles 1104 and 1110 can be formed in wafer chuck 1100.

Figure 12:
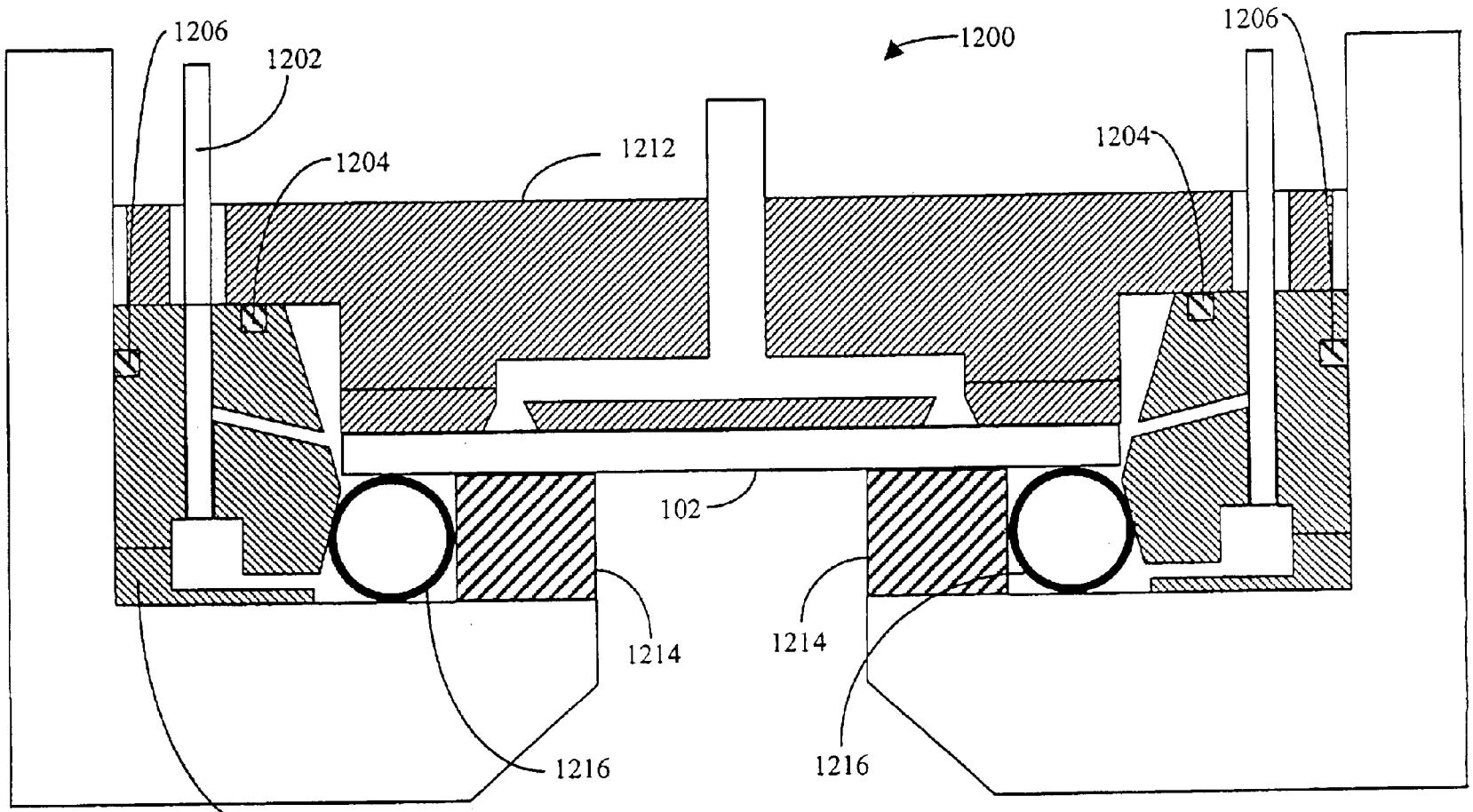
FIG. 12 is a cross section view of a fourth alternative embodiment of the present invention.

With reference now to FIG. 12, in yet another alternative exemplary embodiment of the present invention, a wafer chuck 1200 according to various aspects of the present invention includes a purge line 1202 and a plurality of seal rings 1204 and 1206. In the present exemplary embodiment, seal ring 1206 forms a seal between conducting member 1208 and bottom section 1210. Similarly seal ring 1204 forms a seal between conducting member 1208 and top section 1212. As a result, by feeding positive pressure gas into purge line 1202 and checking for leakage, the seal quality between wafer 102 and seal member 1214 can be checked. Alternatively, purge line 1202 can be pumped to generate negative pressure to check the seal quality between wafer 102 and seal member 1214. If this latter process is used, to prevent electrolyte from being sucked into purge line 1202, the pumping of purge line 1202 should cease after processing of wafer 102, then positive pressure should be injected through purge line 1202 prior to removing wafer 102. After wafer 102 is processed and removed from wafer chuck 1200, by injecting a dry gas (such as argon, nitrogen, and the like) through purge line 1202, residual electrolyte can be purged from spring member 1216 and seal member 1214.

Figure 13:
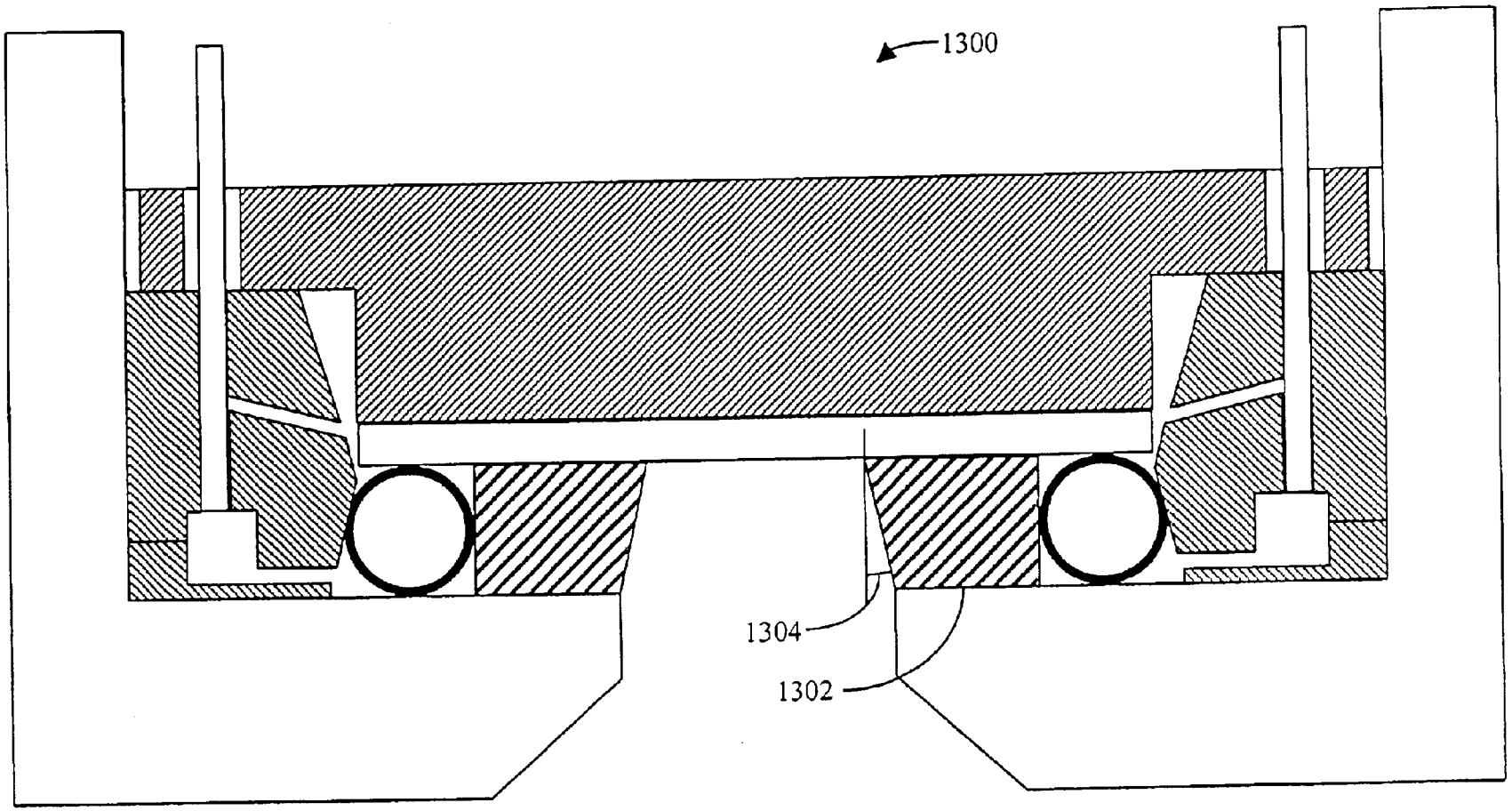
FIG. 13 is a cross section view of a fifth alternative embodiment of the present invention.

With reference now to FIG. 13, in still yet another alternative exemplary embodiment of the present invention, a wafer chuck 1300 according to various aspects of the present invention includes a seal member 1302 having a trapezoidal shape. When wafer chuck 1300 is rotated after processing of wafer 102, the trapezoidal shape of seal member 1302 facilitates the removal of residual electrolyte from seal member 1302. In the present exemplary embodiment, angle 1304 of seal member 1302 can range between about 0 degrees to about 60 degrees, and preferably about 20 degrees.

Figure 14:
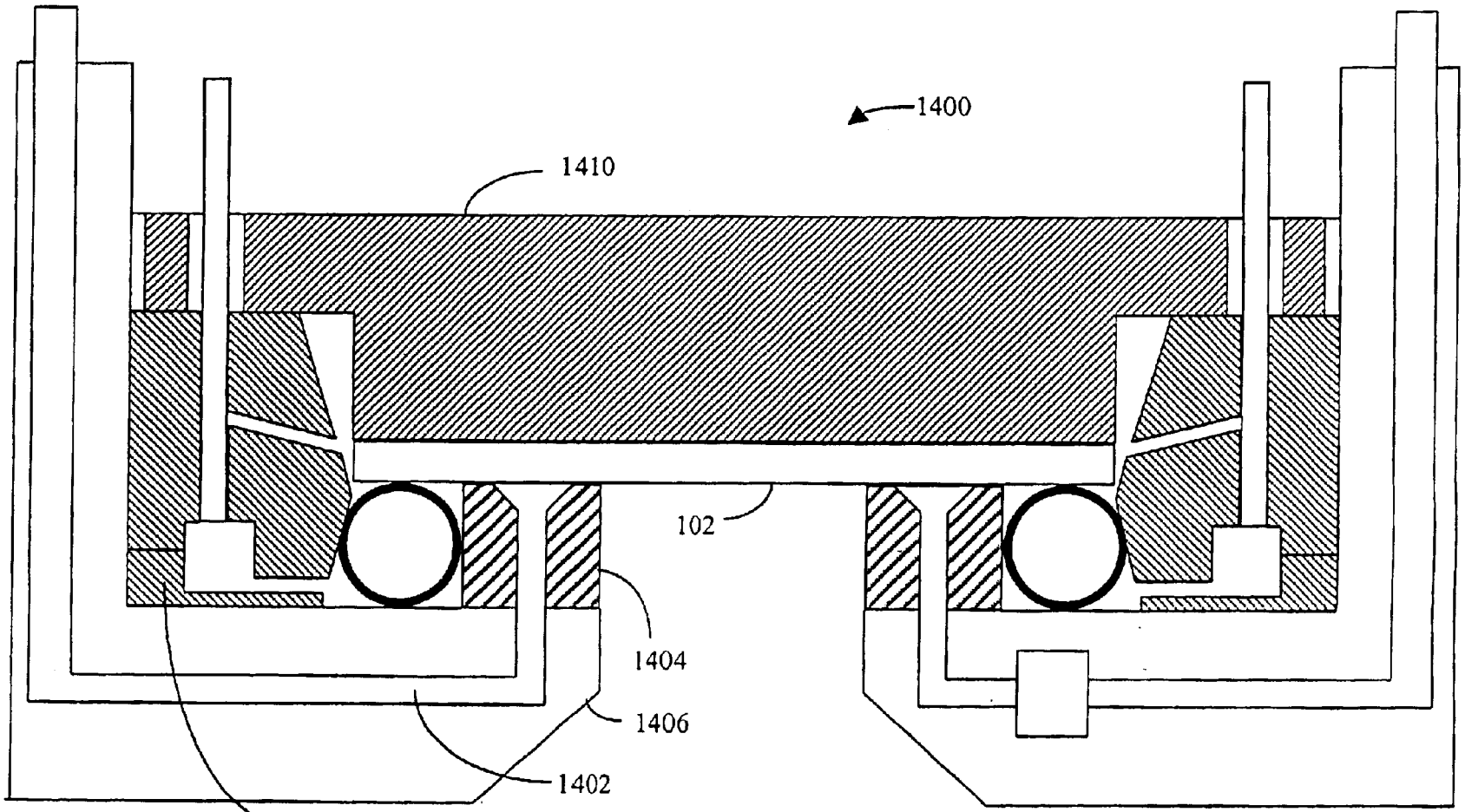
FIG. 14 is a cross section view of a sixth alternative embodiment of the present invention.

With reference now to FIG. 14, in another alternative exemplary embodiment of the present invention, a wafer chuck 1400 according to various aspects of the present invention includes a purge line 1402. In the present exemplary embodiment, purge line 1402 is formed through bottom section 1406 and seal member 1404. By feeding positive pressure gas through purge line 1402, the seal quality between wafer 102 and seal member 1404 can be checked. Alternatively, purge line 1404 can be pumped to generate negative pressure to check the seal quality between wafer 102 and seal member 1404. As noted above, if this latter process is used, to prevent electrolyte from being sucked into purge line 1402, the pumping of purge line 1402 should cease after processing of wafer 102 and positive pressure should be injected through purge line 1402 prior to removing wafer 102

Figure 15:
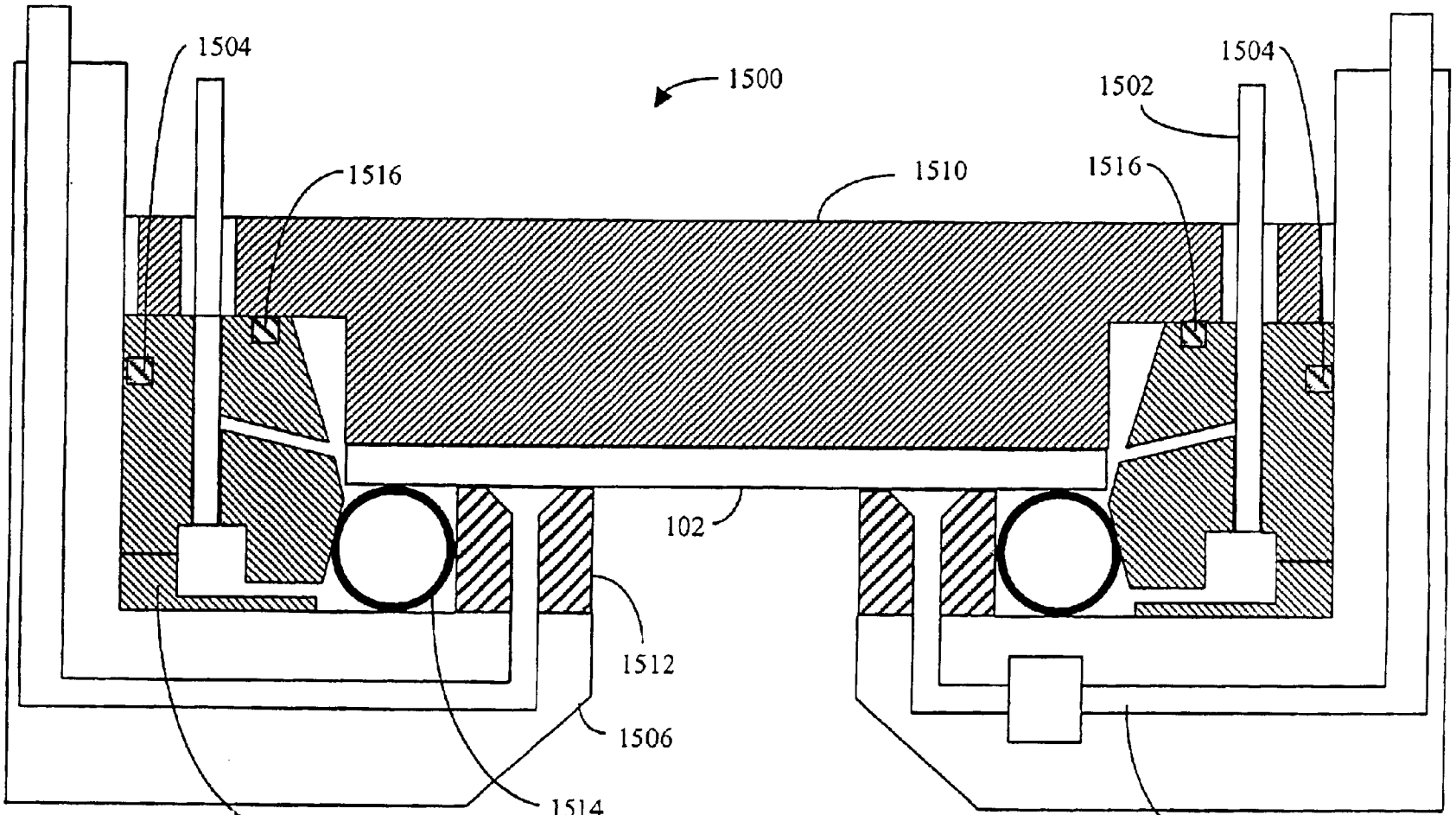
FIG. 15 is a cross section view of a seventh alternative embodiment of the present invention.

With reference now to FIG. 15, in still another alternative exemplary embodiment of the present invention, a wafer chuck 1500 according to various aspects of the present invention includes a purge line 1502, a purge line 1508, and a plurality of seal rings 1516 and 1504. In the present exemplary embodiment, seal ring 1516 forms a seal between conducting member 1518 and top section 1510. Similarly seal ring 1504 forms a seal between conducting member 1518 and bottom section 1506. As a result, the seal quality between wafer 102 and seal member 1512 can be checked using purge line 1502 and/or purge line 1508.

More particularly, in one configuration, the seal quality can be checked by feeding pressure gas into purge line 1502 and purge line 1508 and checking for leakage. In another configuration, purge line 1502 and purge line 1508 can be pumped to generate negative pressure to check the seal quality between wafer 102 and seal member 1512. In still another configuration, either purge line 1502 or purge line 1508 can be fed with pressure while the other is pumped to generate negative pressure. When negative pressure is used to check for leakage, to prevent electrolyte from being sucked into purge line 1502 and/or purge line 1508, pumping should cease after processing of wafer 102, then positive pressure should be injected through purge line 1502 and/or purge line 1508 prior to removing wafer 102. After wafer 102 is processed and removed from wafer chuck 1500, by injecting a dry gas (such as argon, nitrogen, and the like) through purge line 1502 and/or purge line 1508, residual electrolyte can be purged from seal member 1512 and spring member 1514.

Figure 16:
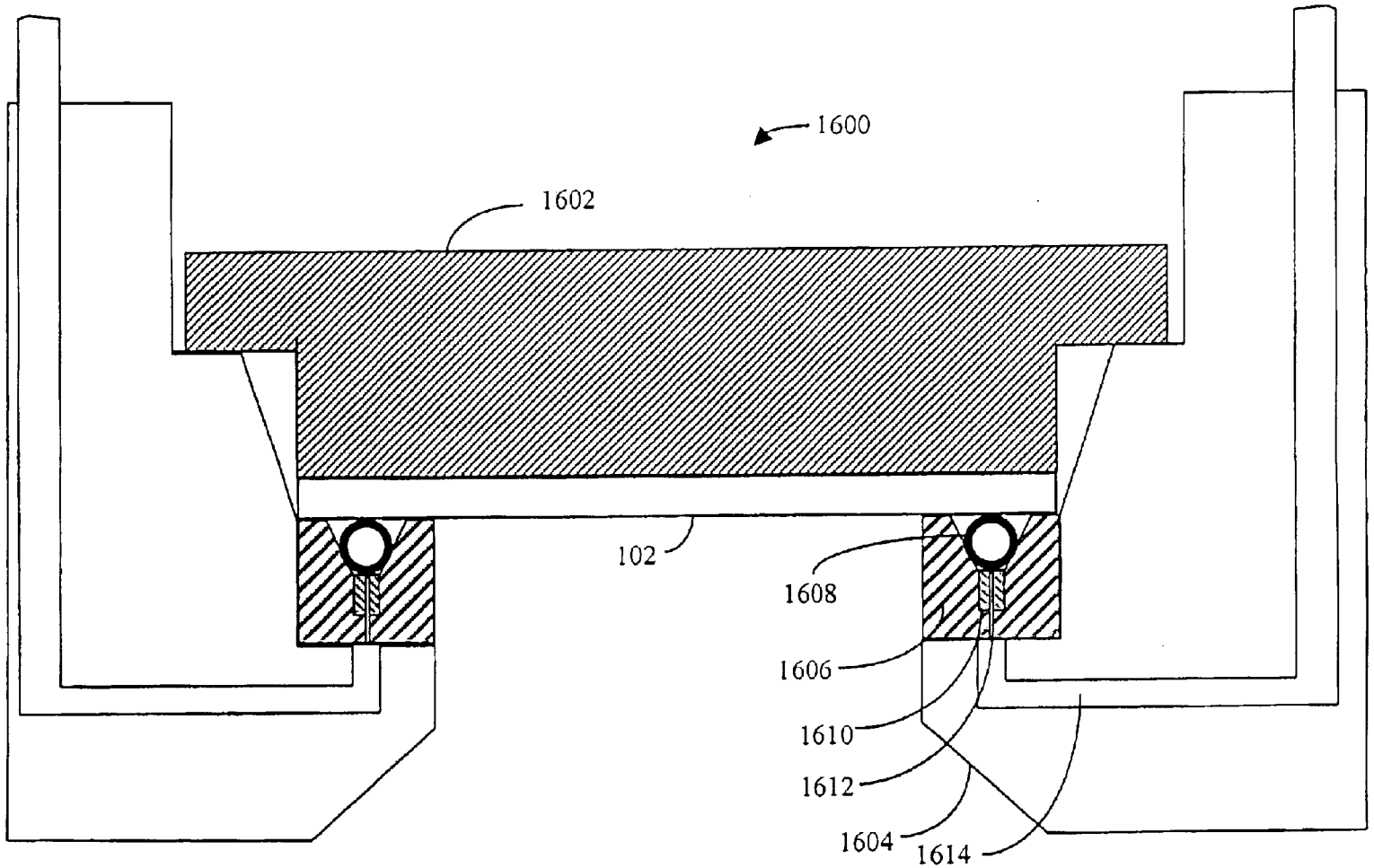
FIG. 16 is a cross section view of an eighth alternative embodiment of the present invention.

With reference now to FIG. 16, in another alternative exemplary embodiment of the present invention, a wafer chuck 1600 according to various aspects of the present invention includes a spring member 1608, a conducting member 1610 and a seal member 1606. In the present exemplary embodiment, spring member 1608 and conducting member 1610 are disposed within seal member 1606. This configuration has the advantage that spring member 1608, conducting member 1610, and seal member 1606 can be pre-assembled.

Wafer chuck 1600 further includes a purge line 1614 and a plurality of nozzles 1612 formed through seal member 1614 and conducting member 1610. By feeding positive pressure gas through purge line 1614, the seal quality between wafer 102 and seal member 1606 can be checked. Alternatively, purge line 1614 can be pumped to generate negative pressure to check the seal quality between wafer 102 and seal member 1606. As noted above, if this latter process is used, to prevent electrolyte from being sucked into purge line 1614, the pumping of purge line 1614 should cease after processing of wafer 102, then positive pressure should be injected through purge line 1614 prior to removing wafer 102

Figure 17:
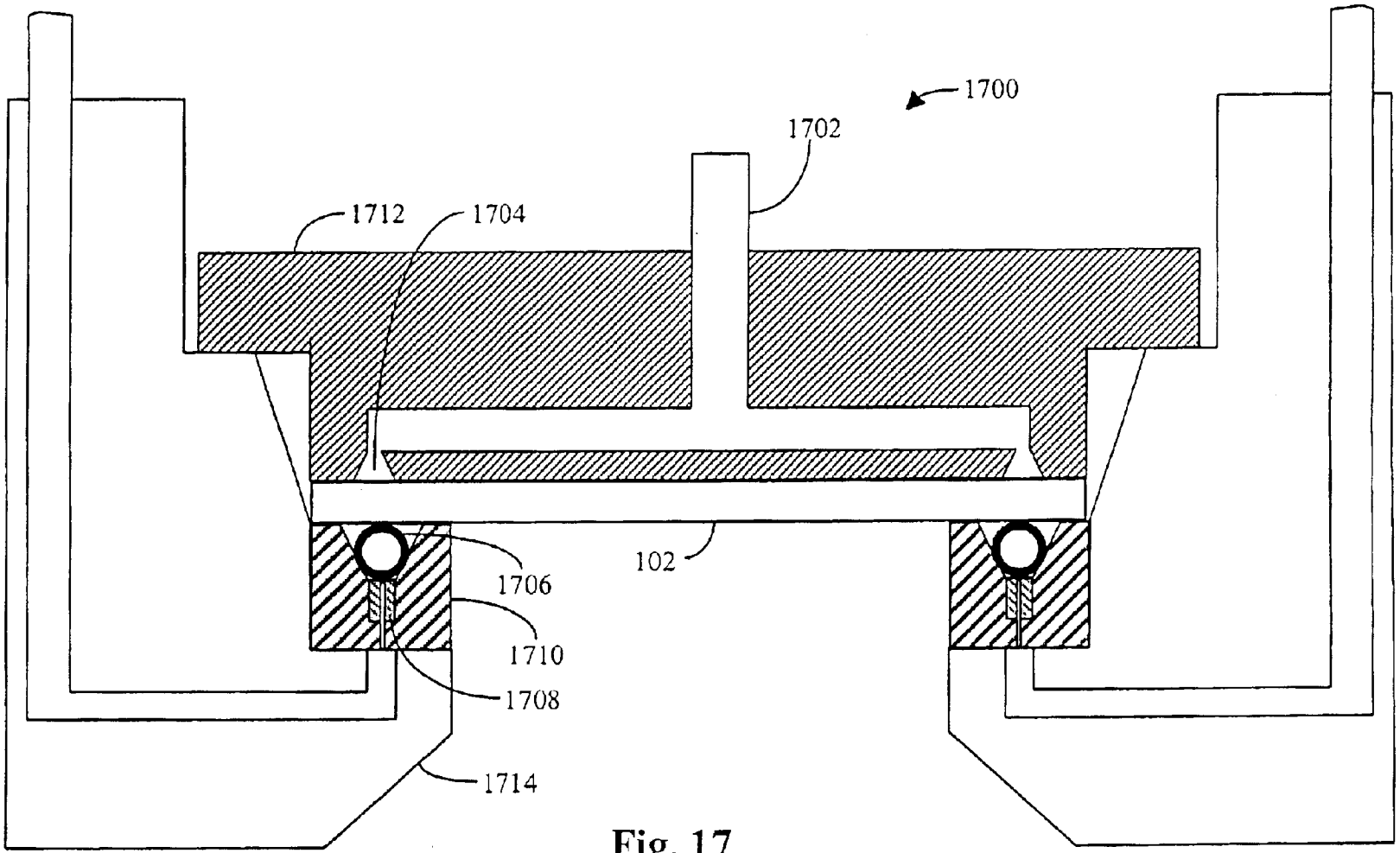
FIG. 17 is a cross section view of a ninth alternative embodiment of the present invention.

With reference now to FIG. 17, in still another alternative exemplary embodiment of the present invention, a wafer chuck 1700 includes a purge line 1702 and a plurality of nozzles 1704. In the present exemplary embodiment, purge line 1702 and plurality of nozzles 1704 inject a dry gas (such as argon, nitrogen, and the like) onto seal member 1710, conducting member 1708, and spring member 1706. In this manner, after wafer 102 is processed and removed from wafer chuck 1700, residual electrolyte can be purged from the tops of seal member 1710, conducting member 1708, and spring member 1706. As depicted in FIG. 17, in the present exemplary embodiment, purge line 1702 and plurality of nozzles 1704 are formed in top section 1712. It should be recognized, however, that wafer chuck 1700 can be suitably configured in a variety of manners with purge line 1702 and plurality of nozzles 1704 without deviating from the spirit and/or scope of the present invention. Furthermore, it should be recognized that any number of purge lines 1702 and nozzles 1704 can be formed in wafer chuck 1700.

Figure 18:
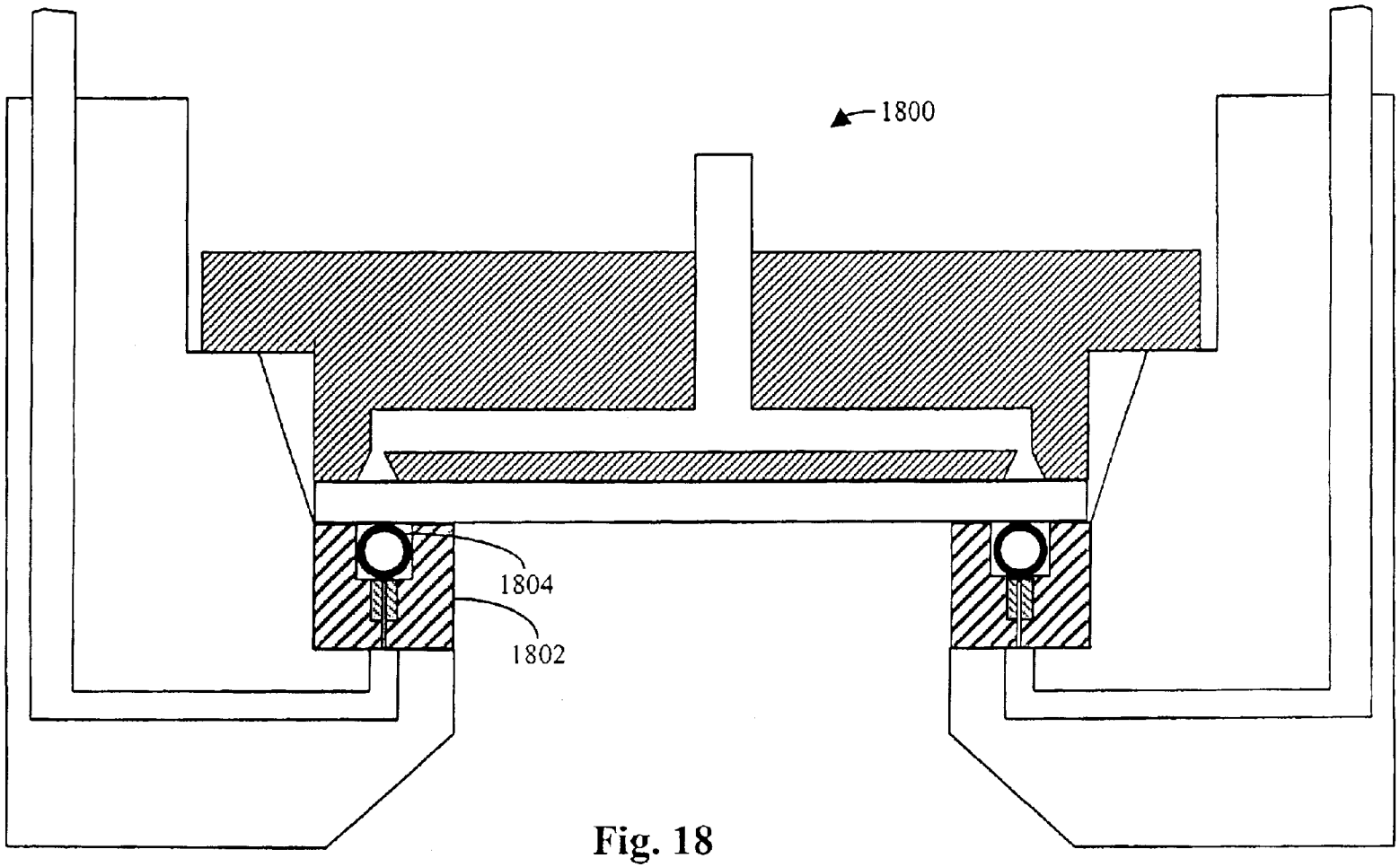
FIG. 18 is a cross section view of a tenth alternative embodiment of the present invention.

With reference now to FIG. 18, in yet another alternative exemplary embodiment of the present invention, a wafer chuck 1800 includes a seal member 1802. In the present exemplary embodiment, seal member 1802 is formed with a square interior groove for receiving spring member 1804. This configuration has the advantage of more securely receiving spring member 1804. It should be recognized, however, seal member 1802 can be formed with a variety of shapes depending on the particular application.

Figure 19:
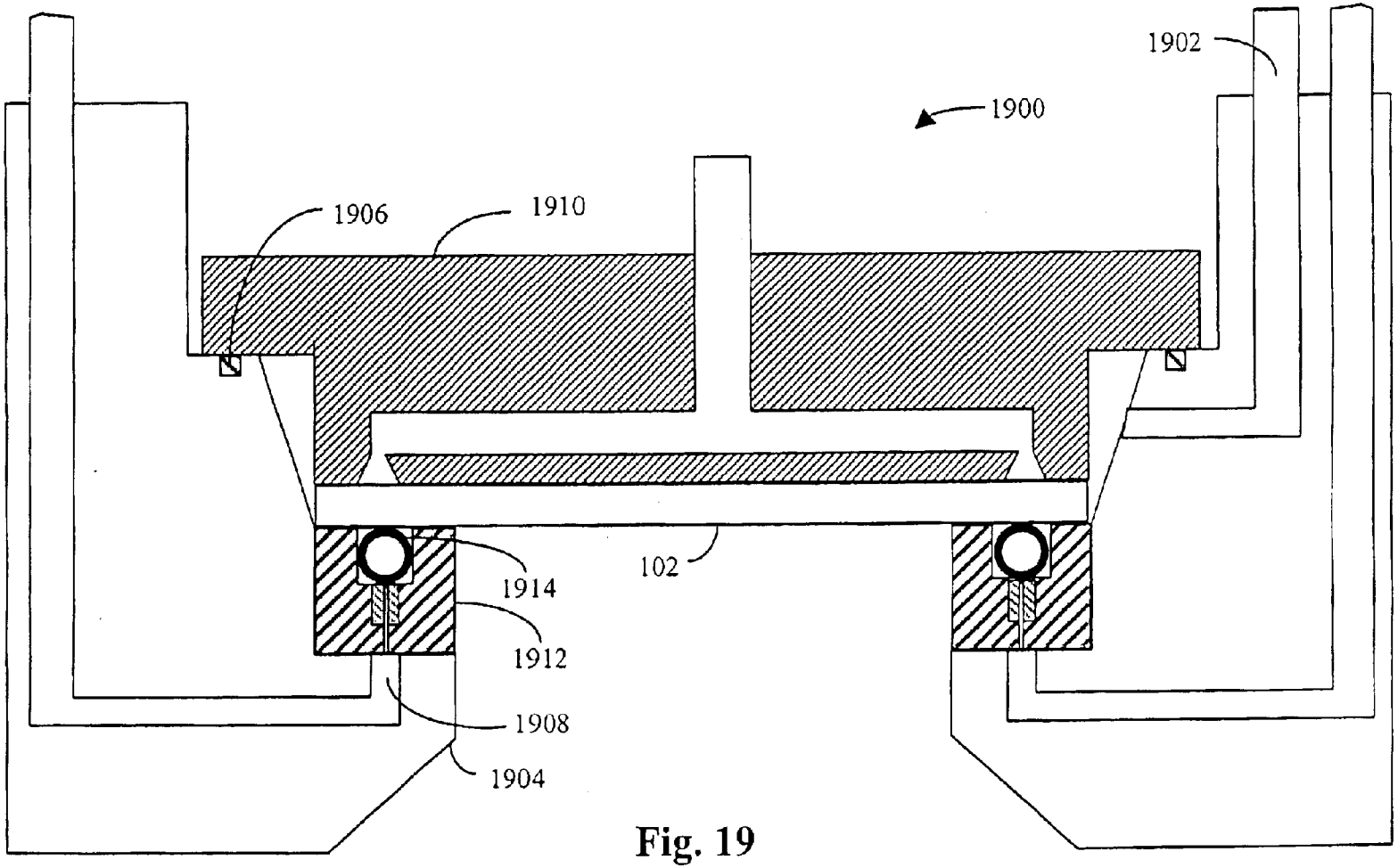
FIG. 19 is a cross section view of an eleventh alternative embodiment of the present invention.

With reference now to FIG. 19, in still another alternative embodiment of the present invention, a wafer chuck 1900 according to various aspects of the present invention includes a purge line 1902, a purge line 1908, and a seal ring 1906. In the present exemplary embodiment, seal ring 1906 forms a seal between bottom section 1904 and top section 1910. As a result, the seal quality between wafer 102 and seal member 1912 can be checked using purge line 1902 and/or purge line 1908.

More particularly, in one configuration, the seal quality can be checked by feeding pressure gas into purge line 1902 and purge line 1908 and checking for leakage. In another configuration, purge line 1902 and purge line 1908 can be pumped to generate negative pressure to check the seal quality between wafer 102 and seal member 1912. In still another configuration, either purge line 1902 or purge line 1908 can be fed with pressure while the other is pumped to generate negative pressure. When negative pressure is used to check for leakage, to prevent electrolyte from being sucked into purge line 1902 and/or purge line 1908, pumping should cease after processing of wafer 102, then positive pressure should be injected through purge line 1902 and/or purge line 1908 prior to removing wafer 102. After wafer 102 is processed and removed from wafer chuck 1900, by injecting a dry gas (such as argon, nitrogen, and the like) through purge line 1902 and/or purge line 1908, residual electrolyte can be purged from seal member 1912 and spring member 1914.

Figure 20:
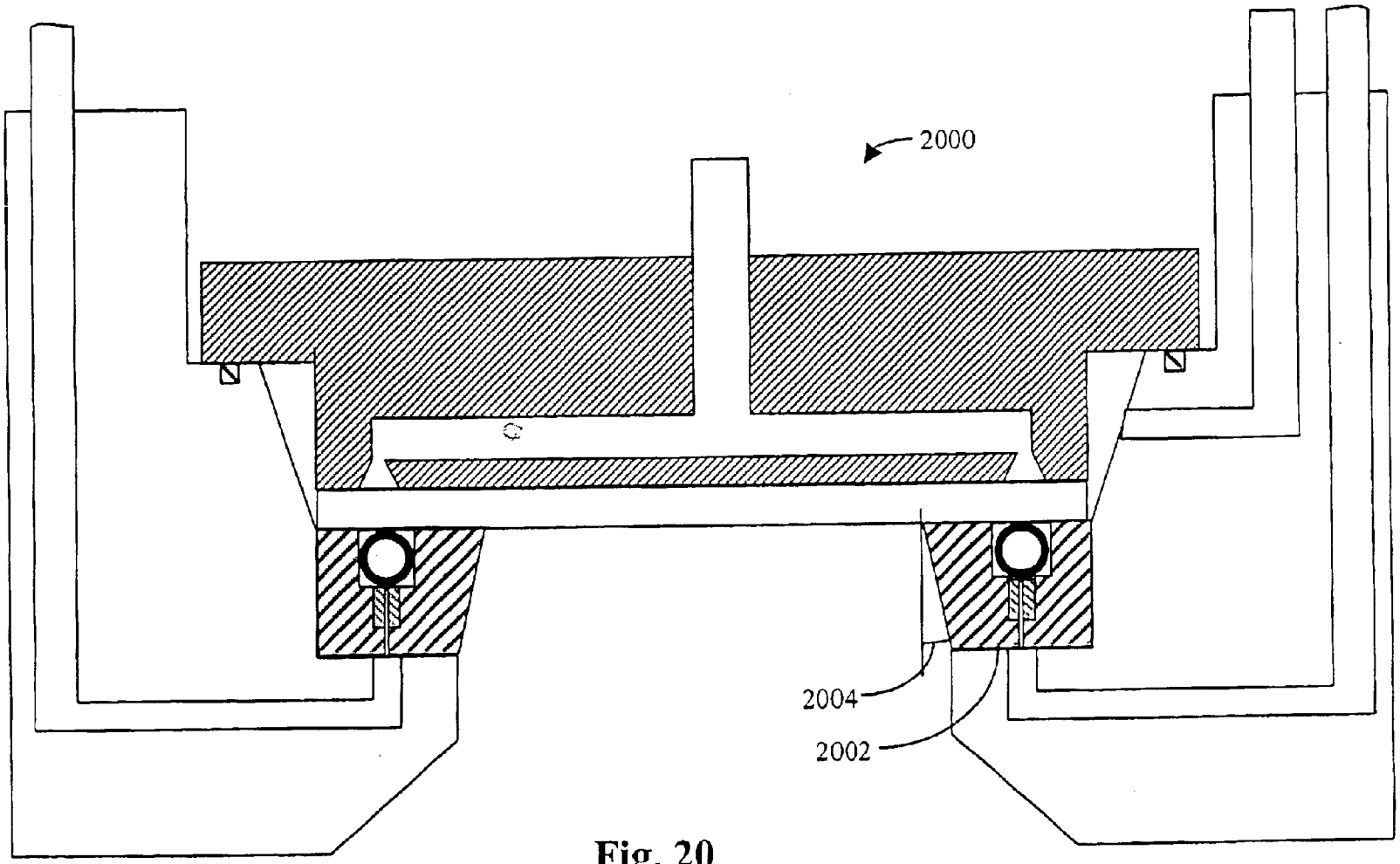
FIG. 20 is a cross section view of a twelfth alternative embodiment of the present invention.

With reference now to FIG. 20, in still yet another alternative exemplary embodiment of the present invention, a wafer chuck 2000 according to various aspects of the present invention includes a seal member 2002 having a trapezoidal shape. When wafer chuck 2000 is rotated after processing of wafer 102, the trapezoidal shape of seal member 2002 facilitates the removal of residual electrolyte from seal member 2002. In the present exemplary embodiment, angle 2004 of seal member 2002 can range between about 0 degrees to about 60 degrees, and preferably about 20 degrees.

As stated earlier, although the present invention has been described in conjunction with a number of alternative embodiments illustrated in the appended drawing figures, various modifications can be made without departing from the spirit and/or scope of the present invention. Therefore, the present invention should not be construed as being limited to the specific forms shown in the drawings and described above.

What is claimed is:

1. A wafer chuck assembly for a semiconductor wafer, the assembly comprising:

a top section;

a shaft attached to the top section;

a collar configured to slip along the shaft;

a bottom section;

a rod attached to the collar and the bottom section, wherein the rod separates the top section and the bottom section for removal and insertion of the semiconductor wafer between the top section and the bottom section; and a spring disposed around the rod, wherein the spring brings together the top section and the bottom section for holding the semiconductor wafer between the top section and the bottom section.

2. The assembly of claim 1, wherein the rod includes two or more rods, and wherein each rod includes:

a first end rigidly fixed to the collar; and a second end rigidly fixed to the bottom section.

3. The assembly of claim 1, wherein the spring is disposed between the collar and the top section.

4. The assembly of claim 3, wherein the spring is compressed between the collar and the top section to separate the top section and the bottom section, and wherein the spring is extended to bring together the top section and the bottom section.

5. The assembly of claim 3, wherein the rod includes two or more rods, wherein the spring includes two or more springs, and each spring is disposed around each rod.

6. The assembly of claim 1, wherein the shaft is configured to move the top section between a first position and a second position, wherein the rod separates the top and the bottom section when the top section is in the first position, and wherein the spring brings together the top section and the bottom section when the top section is in the second position.

7. The assembly of claim 6 further comprising:

a support housing, wherein the shaft extends through the support housing, and wherein the support housing is disposed above the collar, the top section, the bottom section, the rod, and the spring.

8. The assembly of claim 7, wherein the collar contacts the support housing and compresses the spring to separate the top section and the bottom section as the top section is moved from the second position to the first position.

9. The assembly of claim 8, wherein the spring extends between the collar and the top section to bring together the top section and the bottom section as the top section is moved from the first position to the second position.

10. The assembly of claim 7 further comprising:

an electrolyte solution receptacle, wherein the top section and the bottom section are disposed within the electrolyte solution receptacle when the top section is in the second position, and wherein the semiconductor wafer is electropolished and/or electroplated within the electrolyte solution receptacle.

11. A wafer chuck assembly for a semiconductor wafer, the assembly comprising:

a bottom section;

a top section;

a shaft attached to the top section, wherein the shaft is configured to move the top section between a first position and a second position, wherein the bottom section and top section are separated when in the first position for insertion or removal of the semiconductor wafer, and wherein the bottom section and top section are brought together when in the second position for holding the semiconductor wafer;

a collar configured to slip along the shaft;

a rod attached to the collar and the bottom section; and a spring disposed between the collar and the top section, wherein the spring is compressed between the collar and the top section when the top section is in the first position, and wherein the spring is extended between the collar and the top section when the top section is in the second position.

12. The assembly of claim 11 further comprising:

a support housing, wherein the shaft extends through the support housing, and wherein the support housing is disposed above the collar, the top section, the bottom section, the rod, and the spring.

13. The assembly of claim 12, wherein the collar contacts the support housing and compresses the spring to separate the top section and the bottom section as the top section is moved from the second position to the first position, and wherein the spring extends between the collar and the top section to bring together the top section and the bottom section as the top section is moved from the first position to the second position.

14. The assembly of claim 11, wherein the rod includes two or more rods, wherein the spring includes two or more springs, and each spring is disposed around each rod.

15. The assembly of claim 11 further comprising:

an electrolyte solution receptacle, wherein the top section and the bottom section are disposed within the electrolyte solution receptacle when the top section is in the second position, and wherein the semiconductor wafer is electropolished and/or electroplated within the electrolyte solution receptacle.

16. A method of operating a wafer chuck assembly for a semiconductor wafer, the method comprising:

moving a top section of the wafer chuck assembly to a first position, wherein the top section is separated from a bottom section of the wafer chuck assembly when the top section is in the first position, and wherein a spring is compressed between the top section and a collar disposed around a shaft attached to the top section when the top section is in the first position; and moving the top section of the wafer chuck assembly to a second position, wherein the top section is brought together with the bottom section of the wafer chuck assembly when the top section is in the second position, and wherein the spring is extended between the top section and the collar when the top section is in the second position.

17. The method of claim 16 further comprising:

inserting a semiconductor wafer between the top section and the bottom section when the top section is in the first position; and removing a semiconductor wafer from between the top section and the bottom section when the top section is in the first position.

18. The method of claim 16, wherein the collar contacts a support housing and compresses the spring to separate the top section and the bottom section as the top section is moved from the second position to the first position.

19. The method of claim 18, wherein the spring extends between the collar and the top section to bring together the top section and the bottom section as the top section is moved from the first position to the second position.

20. The method of claim 16, wherein the top section and the bottom section are disposed within an electrolyte solution receptacle when the top section is in the second position, and further comprising:

applying an electrolyte solution to the semiconductor wafer to electropolish and/or electroplate the semiconductor wafer.

* * * * *